US008991296B2

(12) United States Patent
Inoue et al.

(10) Patent No.: US 8,991,296 B2
(45) Date of Patent: Mar. 31, 2015

(54) COMPRESSOR

(75) Inventors: Yoshinori Inoue, Kariya (JP); Hirokazu Mesaki, Kariya (JP); Masaya Sakamoto, Kariya (JP); Atsuhiro Suzuki, Kariya (JP); Akinobu Kanai, Kariya (JP); Tomoji Tarutani, Kariya (JP); Naoki Koeda, Kariya (JP); Osamu Nakayama, Kariya (JP)

(73) Assignee: Kabushiki Kaisha Toyota Jidoshokki (JP)

( * ) Notice: Subject to any disclaimer, the term of this patent is extended or adjusted under 35 U.S.C. 154(b) by 1526 days.

(21) Appl. No.: 12/095,424

(22) PCT Filed: Mar. 20, 2007

(86) PCT No.: PCT/JP2007/055631

§ 371 (c)(1),
(2), (4) Date: Sep. 17, 2009

(87) PCT Pub. No.: WO2007/111194

PCT Pub. Date: Oct. 4, 2007

(65) Prior Publication Data

US 2010/0018386 A1 Jan. 28, 2010

(30) Foreign Application Priority Data

Mar. 29, 2006 (JP) ..... 2006-089907
May 29, 2006 (JP) ..... 2006-147585
Dec. 20, 2006 (JP) ..... 2006-342055

(51) Int. Cl.
*F15B 21/04* (2006.01)
*F04B 27/10* (2006.01)
(Continued)

(52) U.S. Cl.
CPC ..... *F04B 27/109* (2013.01); *F04B 49/225* (2013.01); *F04B 2027/1872* (2013.01)
USPC ..... 92/79

(58) Field of Classification Search
USPC ..... 60/453; 91/46; 92/154, 78, 79; 418/83; 62/470
See application file for complete search history.

(56) References Cited

U.S. PATENT DOCUMENTS 3,669,579 A * 6/1972 Carter ..... 418/83
4,283,997 A * 8/1981 Takahashi et al. ..... 92/79
(Continued)

FOREIGN PATENT DOCUMENTS

JP 05240158 9/1993
JP 200002183 1/2000
(Continued)

OTHER PUBLICATIONS

JP2005120970 English machine translation. 2005.*
(Continued)

*Primary Examiner* — Thomas E Lazo
*Assistant Examiner* — Michael Quandt
(74) *Attorney, Agent, or Firm* — Baker & Hostetler LLP

(57) ABSTRACT

The compressor is provided with an oil separator for separating oil from refrigerant gas introduced into a separation chamber, an annular space for reserving oil separated from the refrigerant gas, and a reservoir chamber for reserving the thus separated oil. The oil separator is provided in a cylindrical hole formed in a discharge chamber from which the refrigerant gas is discharged and a lid for partitioning the cylindrical hole from the discharge chamber is provided in the cylindrical hole. The oil separator introduces the refrigerant gas from the discharge chamber to the separation chamber via the introduction passage. The annular space is provided around the lid and connected to the reservoir chamber via an oil passage. The reservoir chamber is connected to a crank chamber of a pressure lower than that in the discharge chamber.

16 Claims, 17 Drawing Sheets

(51) Int. Cl.
*F04B 49/22* (2006.01)
*F04B 27/18* (2006.01)

(56) References Cited

U.S. PATENT DOCUMENTS

| | | | | | |
|---|---|---|---|---|---|
| 4,290,345 | A | * | 9/1981 | Hiraga et al. | 92/79 |
| 5,159,820 | A | * | 11/1992 | Ohishi et al. | 62/468 |
| 5,580,224 | A | * | 12/1996 | Ikeda et al. | 417/269 |
| 5,636,974 | A | | 6/1997 | Ikeda et al. | |
| 5,823,294 | A | * | 10/1998 | Mizutani et al. | 184/6.3 |
| 6,015,269 | A | * | 1/2000 | Ota et al. | 417/222.2 |
| 6,179,578 | B1 | | 1/2001 | Kayukawa et al. | |
| 7,856,818 | B2 | * | 12/2010 | Inoue et al. | 60/454 |
| 2002/0136652 | A1 | * | 9/2002 | Gennami et al. | 418/55.6 |
| 2004/0179952 | A1 | | 9/2004 | Iizuka | |
| 2004/0221610 | A1 | * | 11/2004 | Yamada et al. | 62/470 |
| 2007/0140870 | A1 | * | 6/2007 | Fukanuma et al. | 417/269 |

FOREIGN PATENT DOCUMENTS

| | | | |
|---|---|---|---|
| JP | 2004211662 | | 7/2004 |
| JP | 2004218610 | | 8/2004 |
| JP | 2004293543 | | 10/2004 |
| JP | 2005120970 | * | 5/2005 |
| KR | 1020030058838 | * | 3/2005 |

OTHER PUBLICATIONS

KR1020030058838 English machine translation. 2005.*

* cited by examiner

COMPRESSOR

FIELD OF THE INVENTION

The present invention relates to a compressor which separates, for example, oil contained in discharged gas and returns the separated oil to a low pressure zone.

BACKGROUND OF THE INVENTION

Patent Document 1 discloses a compressor equipped with an oil reservoir chamber. An oil separation chamber is formed in the rear housing member of the compressor so as to extend in the radial direction of the rear housing member, and the oil reservoir chamber is provided below the oil separation chamber and also at the rear end of the rear housing member so as to project outwardly. A through hole connecting the oil separation chamber with the oil reservoir chamber is formed in the rear housing member. Further, the rear housing member is provided with a discharge chamber for discharging compressed refrigerant gas including misted oil and an inflow passage for connecting the discharge chamber with the oil separation chamber. The oil separation chamber is connected to a discharge hole, and a check valve unit for preventing the refrigerant gas from reversely flowing from the oil separation chamber to the discharge chamber is provided in the discharge hole.

The check valve unit has a pipe portion projecting to the oil separation chamber, and the pipe portion and the oil separation chamber constitute oil separating means. A gas return passage, which connects an annular port in a base portion provided in the check valve unit with an oil reservoir chamber, is formed in the rear housing member. The gas return passage is smaller (about 1 mm) in diameter than the through hole and functions as a passage for returning the refrigerant gas which has entered the oil reservoir chamber to a discharge path including the annular port.

In the above-described compressor, compressed refrigerant gas in the discharge chamber flows into the oil separation chamber by way of the inflow passage. The refrigerant gas, which has entered the oil separation chamber, collides with the outer circumferential surface of the pipe portion and swirls around the outer circumferential surface, by which misted oil contained in the refrigerant gas is separated from the refrigerant gas. The thus separated oil collects at the bottom of the oil separation chamber and flows into the oil reservoir chamber from an inlet of the through hole.

Oil contained in the oil reservoir chamber is returned through the oil return passage to a crank chamber and others. Refrigerant gas, from which oil has been separated, is supplied to an external refrigerant circuit through a discharge pipe by way of a pipe portion, a check valve and others. Since the gas return passage is formed between the discharge path and the oil reservoir chamber of refrigerant gas, a flow of refrigerant gas is created due to a pressure difference $\Delta P$ between the oil separation chamber and the discharge path. Oil, which has been separated from refrigerant gas in the oil separation chamber, joins with the flow and immediately flows into the oil reservoir chamber through the through hole.

Patent Document 2 discloses a swash-plate type compressor equipped with an oil separation chamber. A projected portion is provided in an upper part of the rear cylinder block of the compressor, and a cyclone-type oil separation chamber is formed in the projected portion. Further, the compressor is provided with a connecting hole adjacent to the oil separation chamber and the connecting hole is connected to a muffler chamber formed in the rear cylinder block. A primary oil reservoir for collecting separated oil is formed below the oil separation chamber. A main oil reservoir is provided on the side of the oil separation chamber and the primary oil reservoir. An oil return hole connected to a swash plate chamber, which is a low pressure zone, is opened in a valve seat face at the bottom of the main oil reservoir. A reed valve made of a spring steel plate is provided in the opening of the oil return hole, and the reed valve is deformed depending on a pressure difference between a high pressure zone and a low pressure zone and capable of controlling the flow rate of oil flowing through the oil return hole.

In the above-described compressor, high-pressure compressed refrigerant gas flowing from the discharge chamber into the muffler chamber is introduced into an oil separation chamber via the connecting hole. The refrigerant gas introduced into the oil separation chamber swirls along the circumferential wall of the oil separation chamber, by which misted oil contained in the refrigerant gas is separated from the refrigerant gas by the actions of centrifugal force. The thus separated oil is collected in the primary oil reservoir and reserved in the main oil reservoir through the connecting hole due to a pressure difference between the high pressure zone and the low pressure zone.

The opening degree of the reed valve is controlled depending on a pressure difference between the high pressure zone and the low pressure zone. For example, when the pressure difference is small, the reed valve is opened to a great degree. Therefore, a greater amount of oil is returned from the main oil reservoir to the swash plate chamber through the oil return hole. When the pressure difference is great, the reed valve is opened to a small degree, and a small amount of oil is returned from the main oil reservoir to the swash plate chamber by way of the oil return hole.

However in the compressor disclosed in Patent Document 1, refrigerant gas is allowed to flow due to the pressure difference $\Delta P$, by which oil separated from the oil separation chamber can be directly fed to the oil reservoir chamber. However, when machining constraints such as breakage of cutting tools are taken into account, the oil reservoir chamber must be arranged at a place proximate to the oil separation chamber due to the necessity for providing a small-diameter through hole (about 1 mm). On arrangement of the oil reservoir chamber at a place proximate to the oil separation chamber, the rear housing member is larger in dimension to result in a larger compressor.

In the compressor disclosed in Patent Document 2, a reed valve is provided, by which there is provided a structure to feed oil from the primary oil reservoir to the main oil reservoir due to a pressure difference between the oil separation chamber, which is a high pressure zone, and the swash plate chamber, which is a low pressure zone. However, it is quite difficult to control the opening degree of the reed valve depending on the pressure difference, when consideration is given to variations in the spring constant of a raw material of the reed valve and others in the manufacturing process. Therefore, there is a concern that the opening degree of the reed valve might not be appropriately controlled depending on the pressure difference. Specifically, the reed valve can be opened greatly when there is no intension to feed high-pressure refrigerant gas from the high pressure zone to the low pressure zone. In order to solve this problem, there is proposed an idea that a connecting hole is narrowed in such a manner that high-pressure refrigerant gas is not allowed to enter the swash plate chamber by way of the connecting hole connecting the primary oil reservoir with a main oil reservoir. However, due to the machining constraints, the main oil reservoir needs to be located at a place proximate to the primary oil reservoir. As a result, as in Patent Document 1, the compressor is made large in dimension.

As described above, the compressors disclosed in Patent Document 1 and Patent Document 2 have a problem that the flexibility of the design in arranging an oil separator and a reservoir of separated oil is reduced.

Patent Document 1: Japanese Laid-Open Patent Publication No. 2004-218610

Patent Document 2: Japanese Laid-Open Patent Publication No. 5-240158

SUMMARY OF THE INVENTION

Accordingly, it is an objective of the present invention to provide a compressor that can be made compact.

To achieve the foregoing objective, and in accordance with one aspect of the present invention, a compressor for compressing oil-containing refrigerant gas is proposed. The compressor is provided with a discharge chamber, a discharge passage, a lid, an oil separator, an introduction passage, an oil reservoir, an oil reservoir chamber, and an oil passage. Compressed refrigerant gas is discharged to the discharge chamber. The discharge passage is formed in the discharge chamber. The lid is located in the discharge passage to partition the discharge chamber from the discharge passage. The oil separator is located in the discharge passage, and a separation chamber is formed between the oil separator and the lid. The oil separator separates oil from the refrigerant gas introduced into the separation chamber. The introduction passage introduces the refrigerant gas into the separation chamber from the discharge chamber. The oil reservoir is located around the lid to reserve oil separated from the refrigerant gas. The reservoir chamber reserves the separated oil and is connected to a low pressure zone in the compressor, the pressure of which is lower than the discharge chamber. The oil passage connects the oil reservoir with the reservoir chamber.

BRIEF DESCRIPTION OF THE DRAWINGS

FIG. 15(*b*) is an enlarged view of a main portion of a compressor according to another modification;

DETAILED DESCRIPTION OF THE PREFERRED EMBODIMENTS

Hereinafter, a variable displacement swash plate type compressor (hereinafter, simply referred to as a compressor) according to a first embodiment will be described with reference to FIGS. 1 to 3.

Figure 1:
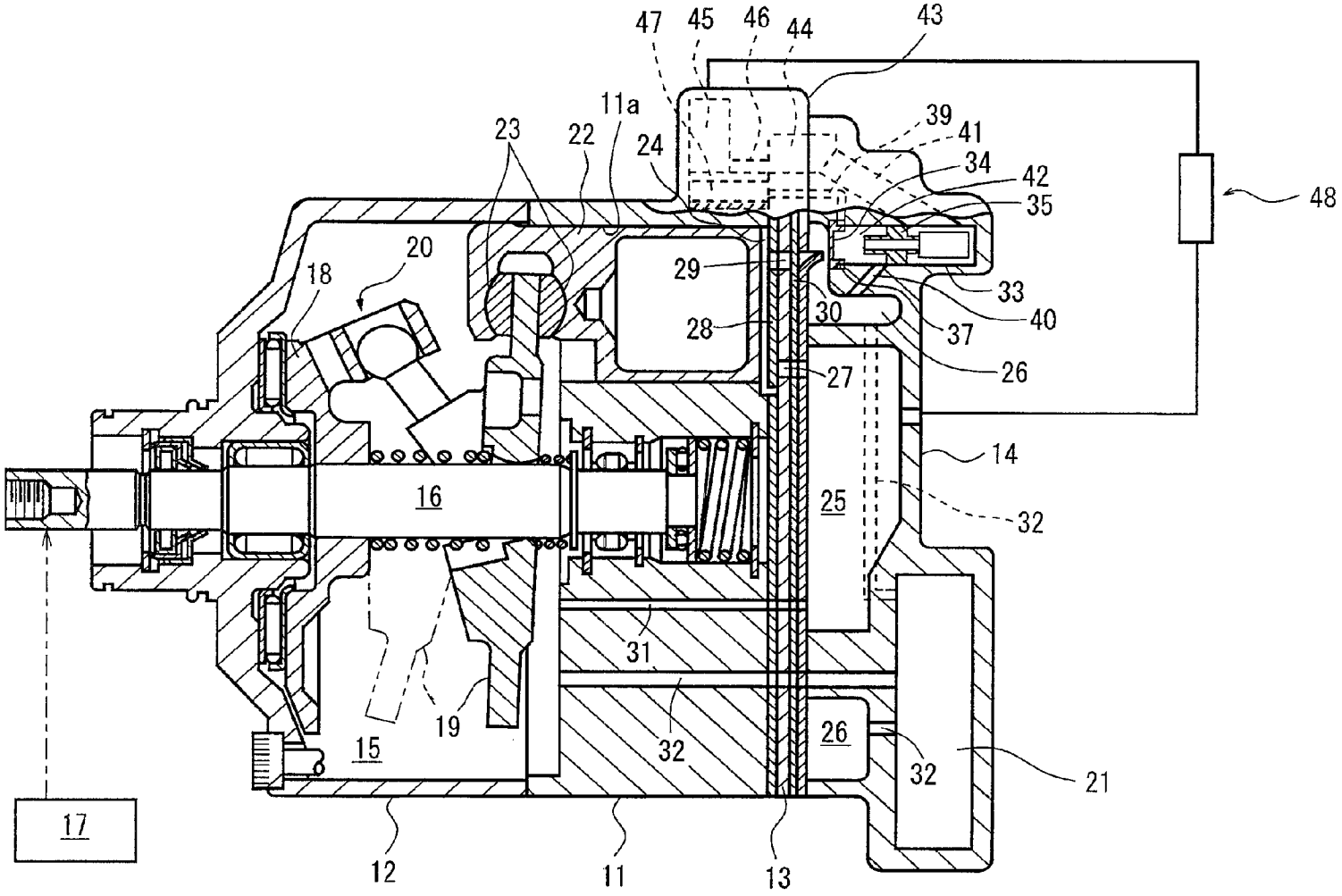
FIG. 1 is a cross-sectional view illustrating a compressor according to a first embodiment of the present invention.

As shown in FIG. 1, the housing of the compressor is provided with a front housing member 12 joined to the front end of a cylinder block 11 and a rear housing member 14 joined to the rear end of the cylinder block 11 via a valve/port forming member 13. A crank chamber 15 is defined in a zone enclosed by the cylinder block 11 and the front housing member 12. A drive shaft 16 is disposed in the crank chamber 15 in a rotatable manner. The drive shaft 16 is coupled to an engine 17 mounted on a vehicle and rotated by energy supplied from the engine 17.

In the crank chamber 15, a lug plate 18 is fixed to the drive shaft 16 so as to make an integrated rotation with the drive shaft 16. Further, a swash plate 19 is accommodated in the crank chamber 15. The swash plate 19 is supported by the drive shaft 16 and capable of sliding on the drive shaft 16 along the axial line of the drive shaft 16 and also capable of tilting with respect to the drive shaft 16. A hinge mechanism 20 is located between the lug plate 18 and the swash plate 19. The swash plate 19 is capable of rotating in synchronization with the lug plate 18 and the drive shaft 16 via the hinge mechanism 20 and also capable of tilting while moving in the axial direction of the drive shaft 16. Further, the inclination angle of the swash plate 19 is controlled by a displacement control valve 21 as described below.

A plurality of cylinder bores 11*a* (only one of them is shown in FIG. 1) are formed in the cylinder block 11, and a single headed piston 22 is accommodated in each of the cylinder bores 11*a* so as to reciprocate. Each of the pistons 22 is anchored on the outer circumference of the swash plate 19 with shoes 23. Therefore, the rotational movement of the swash plate 19 in association with the rotation of the drive shaft 16 is converted to linear reciprocation of the piston 22 with the shoe 23.

Compression chambers 24 each enclosed by one of the pistons 22 and the valve/port forming member 13 are defined on the back face (on the right in FIG. 1) of the cylinder bores 11*a*.

A suction chamber 25 is defined in the rear housing member 14, and a discharge chamber 26 is defined around the suction chamber 25.

Refrigerant gas in the suction chamber 25 is drawn into the compression chamber 24 via a suction port 27 and an inlet valve 28 formed in the valve/port forming member 13 due to the movement of the piston 22 from a position of the top dead center to a position of the bottom dead center. The refrigerant gas drawn into the compression chamber 24 is compressed to a predetermined pressure due to the movement of the piston 22 from a position of the bottom dead center to a position of the top dead center, and then discharged to the discharge chamber 26 via a discharge port 29 and a discharge valve 30 formed in the valve/port forming member 13.

A bleed passage 31 and a supply passage 32 are provided in the housing. The bleed passage 31 is used to exhaust refrigerant gas from the crank chamber 15 to the suction chamber 25. The supply passage 32 is used to introduce the discharged refrigerant gas in the discharge chamber 26 to the crank chamber 15. A displacement control valve 21 is located in the supply passage 32.

The opening degree of the displacement control valve 21 is adjusted, by which the amount of high-pressure refrigerant gas introduced into the crank chamber 15 via the supply passage 32 to the amount of refrigerant gas exhausted from the crank chamber 15 via the bleed passage 31 is controlled to determine a pressure in the crank chamber 15.

Thereby, a difference between the pressure in the crank chamber 15 behind the piston 22 and the pressure in the compression chamber 24 is changed, and an inclination angle of the swash plate 19 with respect to the drive shaft 16 is accordingly changed. As a result, changed is the stroke of each piston 22, that is, the displacement of the compressor.

For example, when the internal pressure of the crank chamber 15 is decreased, the inclination angle of the swash plate 19 is increased, and the compressor displacement is increased. The swash plate 19 indicated by the chain double-dashed line in FIG. 1 is in a state that the inclination angle is maximum. In contrast, when the internal pressure of the crank chamber 15 is increased, the inclination angle of the swash plate 19 is decreased, and the compressor displacement is decreased. The swash plate 19 indicated by the solid line in FIG. 1 is in a state that the inclination angle is minimum.

Figure 2:
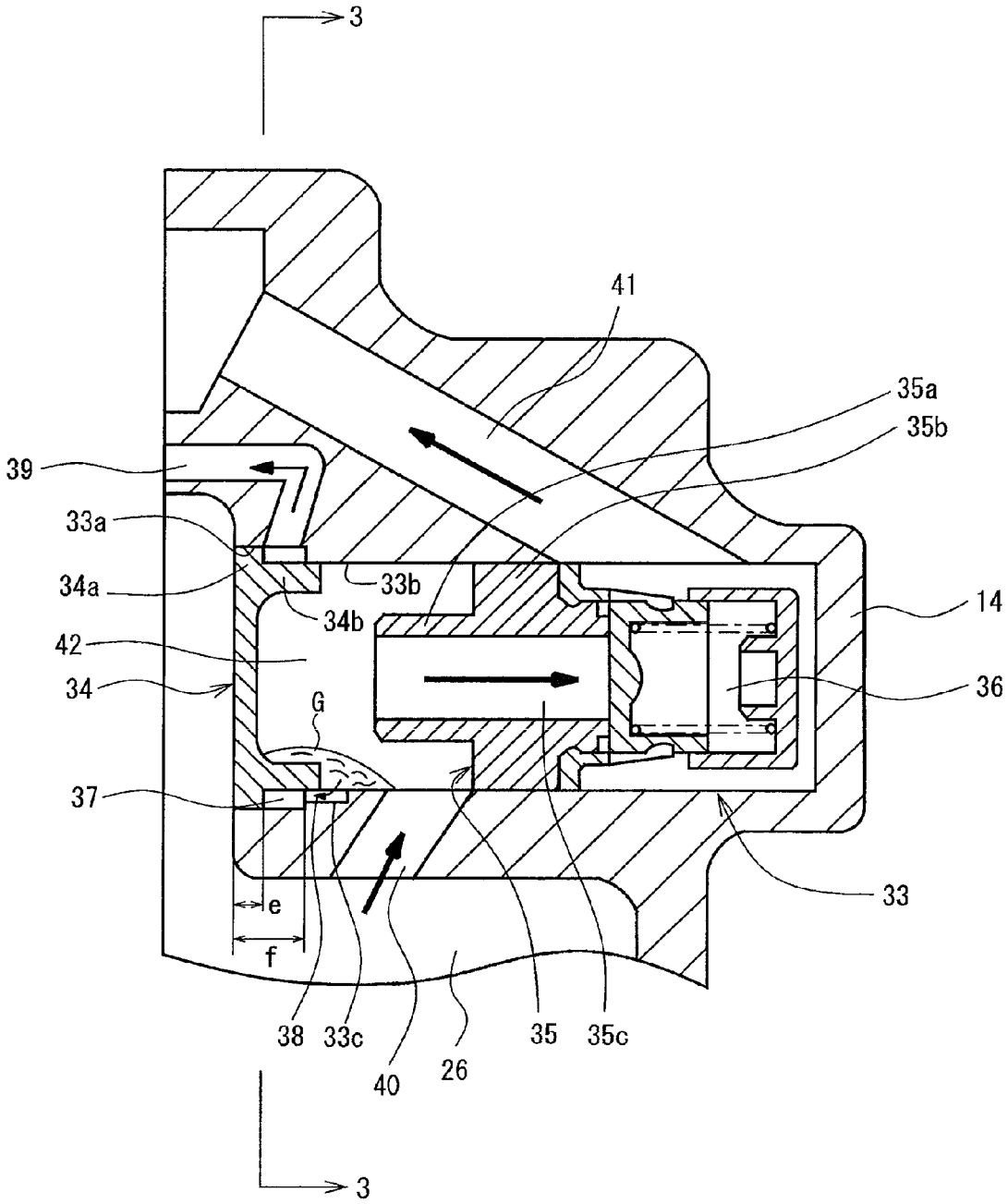
FIG. 2 is an enlarged view of a main portion of the compressor shown in FIG. 1.

As shown in FIGS. 1 and 2, a cylindrical hole 33 is formed in the upper part of the rear housing member 14 so as to be connected to the discharge chamber 26. The cylindrical hole 33 is provided with a discharge passage located in the discharge chamber 26. The cylindrical hole 33 extends parallel with the axial line of the drive shaft 16. A cylindrical oil separator 35 is disposed at the center of the cylindrical hole 33 in the axial direction. The oil separator 35 is fixed to the cylindrical hole 33 by orienting a cylindrical portion 35*a* forward and fitting a base portion 35*b* greater in diameter than the cylindrical portion 35*a* into the cylindrical hole 33. Further, a check valve 36 is accommodated adjacent to the oil separator 35 further behind (on the right in FIG. 2) the center of the cylindrical hole 33 axial direction. A check valve 36 is used to prevent a refrigerant from reversely flowing from an external refrigerant circuit 48 to the discharge chamber 26.

A diameter-enlarged hole 33*a*, which is greater in diameter than the cylindrical hole 33, is formed at the inlet portion of the cylindrical hole 33 (on the left in FIG. 2). Thereby, a step portion is formed on the inner wall surface 33*b* of the cylindrical hole 33. A lid 34 for partitioning the discharge chamber 26 from the cylindrical hole 33 is attached to the inlet portion of the cylindrical hole 33. The lid 34 is provided with a flange portion 34*a* and an outer ring portion 34*b*, and a step portion is formed on the outer circumferential surface of the lid 34 by the flange portion 34*a* and the outer ring portion 34*b*. The lid 34 is fixed to the cylindrical hole 33 by fitting the outer ring portion 34*b* into the inner wall surface 33*b* of the cylindrical hole 33 and also fitting the flange portion 34*a* into the diameter-enlarged hole 33*a*. The thickness dimension e of the flange portion 34*a* in the axial direction is set to be smaller than the depth dimension f of the diameter-enlarged hole 33*a* in the axial direction (e<f).

A separation chamber 42 is formed in a space enclosed by the lid 34, the oil separator 35 and the inner wall surface 33*b* of the cylindrical hole 33. The discharge chamber 26 and the separation chamber 42 are connected via an introduction passage 40, and discharged refrigerant gas is introduced from the discharge chamber 26 to the separation chamber 42 through the introduction passage 40.

Figure 3:
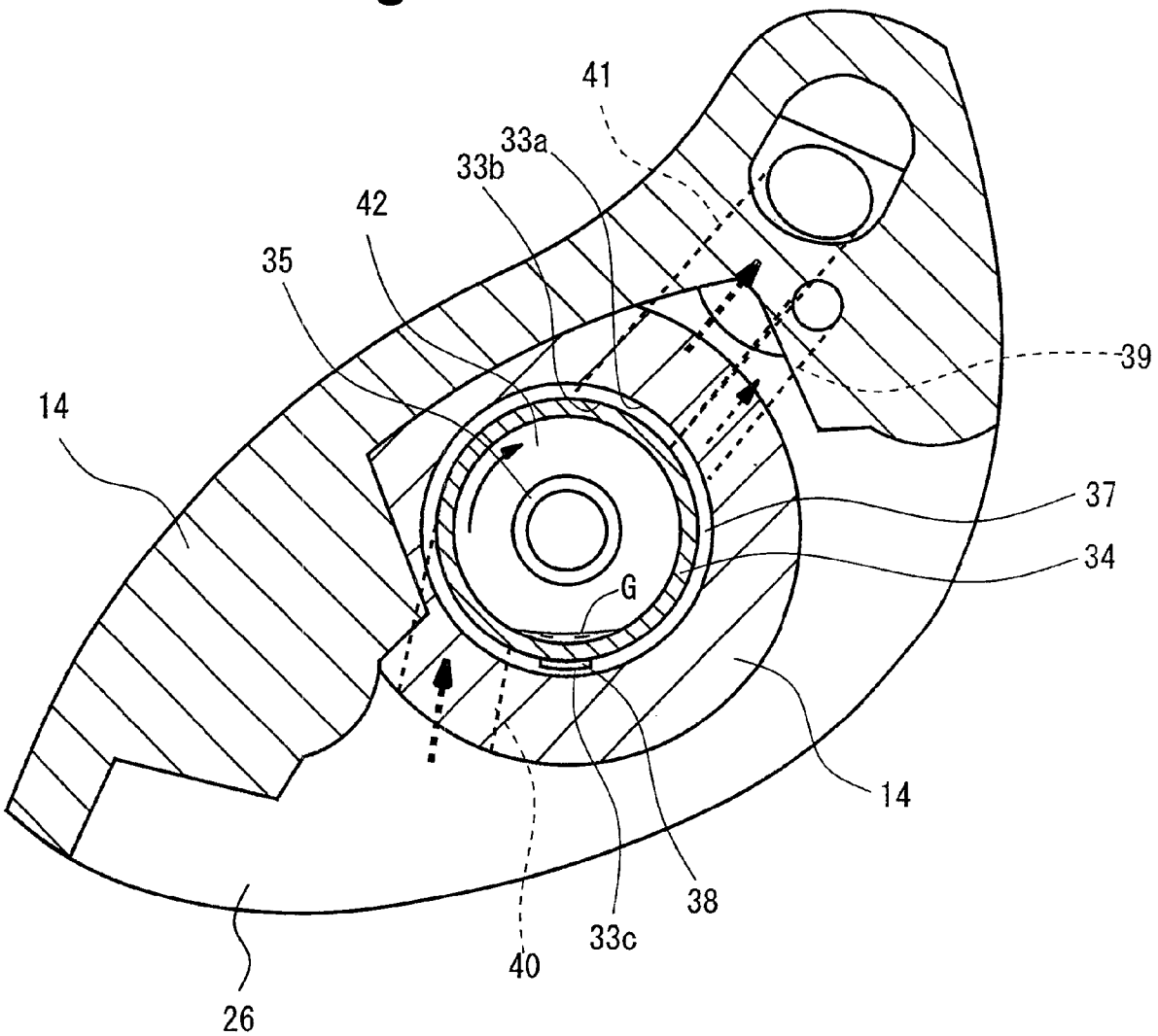
FIG. 3 is a schematic cross-sectional view taken along line 3-3 shown in FIG. 2.

As shown in FIG. 3, the introduction passage 40 is constituted in such a manner that a streamline of discharged refrigerant gas introduced into the separation chamber 42 is given an approximate tangent of the transverse cross-section circle on the inner wall surface 33*b* of the separation chamber 42. Therefore, the discharged refrigerant gas introduced to the separation chamber 42 through the introduction passage 40 swirls along the inner wall surface 33*b* in a clockwise direction.

In the separation chamber 42, the discharged refrigerant gas swirls along the inner wall surface 33*b* in a space between the inner wall surface 33*b* and the cylindrical portion 35*a* of the oil separator 35, by which oil contained in the discharged refrigerant gas is centrifuged from the discharged refrigerant gas. The discharged refrigerant gas, from which oil has been separated, is introduced from the separation chamber 42 into the check valve 36 through a conduit 35*c* in the oil separator 35, and drained to the discharge flange 43 through a drain passage 41. The conduit 35*c* extends through the oil separator 35 in the longitudinal direction and is opened in the separation chamber 42 at a position of the front end, which is opposed to the lid 34. The thus separated oil collects in the vicinity below the lid 34 at the bottom of the separation chamber 42.

In a state that the lid 34 is fitted into the cylindrical hole 33, there is formed an annular space 37 between a step portion on the outer circumferential surface of the lid 34 and a step portion on the inner wall surface 33*b* of the separation chamber 42. The annular space 37 is an annular groove formed around the lid 34, the cross section of which is rectangular. The annular space 37 functions as an oil reservoir connected to the separation chamber 42.

Further, a step 33*c* having a constant width is formed on the inner wall surface 33*b* of the separation chamber 42, which is located below the lid 34 and fitted into the outer ring portion 34*b* of the lid 34. This step 33*c* is used to form a constriction passage 38 which connects the separation chamber 42 with the annular space 37. Therefore, oil G separated from discharged refrigerant gas to collect at the bottom of the separation chamber 42 flows to the annular space 37 through the constriction passage 38.

In FIG. 1, a discharge flange 43 is provided on the upper face of the cylinder block 11 so as to project outwardly. A high pressure fluid chamber 44 and a low pressure fluid chamber 45 are formed in the discharge flange 43, and a constriction portion 46 is provided between the fluid chambers 44, 45. A reservoir chamber 47 for reserving oil is provided below the low pressure fluid chamber 45.

The high pressure fluid chamber 44 is connected to the separation chamber 42 via the drain passage 41, and the low pressure fluid chamber 45 is connected to the external refrigerant circuit 48 via a port (not shown). Therefore, discharged refrigerant gas drained from the separation chamber 42 is introduced into the high pressure fluid chamber 44 through the drain passage 41. The refrigerant gas flows into the low pressure fluid chamber 45 by way of the constriction portion 46.

The reservoir chamber 47 and the annular space 37 are connected via the oil passage 39. Therefore, the separation chamber 42 and the reservoir chamber 47 are connected via the constriction passage 38, the annular space 37 and the oil passage 39. The reservoir chamber 47 is connected to the crank chamber 15, which is a low pressure zone, and others via an oil return passage (not shown).

Next, an explanation will be made for the actions of the above described compressor.

First, when compressed refrigerant gas is discharged from the discharge chamber 26, the discharge refrigerant gas is introduced into the separation chamber 42 through the introduction passage 40. The discharge refrigerant gas introduced into the separation chamber 42 flows toward the front end of the cylindrical portion 35*a*, while swirling along the inner wall surface 33*b* in a space between the inner wall surface 33*b* and the cylindrical portion 35*a* of the oil separator 35. At this time, misted oil contained in the discharged refrigerant gas is separated from the refrigerant gas by the actions of centrifugal force. The thus separated oil swirls inside the separation chamber 42 due to the influence of the swirling refrigerant gas, a part of which drops along the inner wall surface 33*b* of the separation chamber 42 due to its own weight and collects in the vicinity below the lid 34 at the bottom of the separation chamber 42.

Discharged refrigerant gas, from which oil has been separated, is introduced into the check valve 36 from the front end of the cylindrical portion 35*a* of the oil separator 35 through the conduit 35*c*. The discharged refrigerant gas, from which oil has been separated, is drained to the discharge flange 43 through the drain passage 41 after being introduced into the check valve 36. Then, the discharge refrigerant gas introduced into the high pressure fluid chamber 44 of the discharge flange 43 flows into the low pressure fluid chamber 45 and then is supplied to the external refrigerant circuit 48 via the discharge port.

Oil G, which collects at the bottom of the separation chamber 42, flows to the annular space 37 through the constriction passage 38. The annular space 37 and the reservoir chamber 47 are connected, and the reservoir chamber 47 is connected to the crank chamber 15, which is a low pressure zone of a pressure lower than the discharge chamber 26, and others. Therefore, developed is a pressure difference ΔP between the separation chamber 42 and the reservoir chamber 47. That is, the pressure in the separation chamber 42 connected to the discharge chamber 26 is greater than that in the reservoir chamber 47. Oil, which flows from the separation chamber 42 to the annular space 37, elevates along the annular space 37 and flows into the reservoir chamber 47 through the oil passage 39 due to the actions of the pressure difference ΔP.

The oil reserved in the reservoir chamber 47 is returned to the crank chamber 15 and others through an oil return passage (not shown) and used in lubricating sliding parts of the compressor.

As so far described in detail, according to the present embodiment, the following advantages are obtained.

(1) The oil separator 35 is arranged in the cylindrical hole (discharge passage) 33 in the discharge chamber 26, and the lid 34 is used to close the inlet portion of the cylindrical hole 33 to form a separation chamber 42. Then, an annular space 37 is formed around the lid 34, and a constriction passage 38 is provided for connecting the annular space 37 with the separation chamber 42. Thereby, oil G, which collects in the separation chamber 42, is allowed to flow to the reservoir chamber 47 further above the separation chamber 42 through the annular space 37 by utilizing a pressure difference ΔP between the separation chamber 42 and the reservoir chamber 47. Therefore, the annular space 37 and an oil passage 39 for connecting the annular space 37 with the reservoir chamber 47 can be processed by setting the diameter arbitrarily. As a result, the flexibility of the design in arranging the reservoir chamber 47 is improved, which allows the compressor to be miniaturized.

(2) The constriction passage 38 for connecting the annular space 37 with the separation chamber 42 is provided to prevent high-pressure discharge refrigerant gas from reversely flowing from the separation chamber 42 to the reservoir chamber 47, thus allowing only oil G to pass.

(3) The lid 34 is attached between the discharge chamber 26 and the separation chamber 42, by which the separated oil G is reserved in the vicinity below the lid 34 at the bottom of the separation chamber 42, without allowing the gas to flow to the discharge chamber 26. As a result, the thus reserved oil G is effectively drained to the reservoir chamber 47.

(4) Since a step portion provided on the outer circumferential surface of the lid 34 and the inner wall surface of the separation chamber 42 is used to form an annular space 37, no special processing for forming the annular space 37 is needed. Therefore, the annular space 37 is made easily in a reduced number of processing steps.

(5) Only the step portion 33*c* is provided on the inner wall surface 33*b* of the separation chamber 42, thereby forming the constriction passage 38 which connects the separation chamber 42 with the annular space 37. Therefore, the constriction passage 38 can be made easily in a reduced number of processing steps.

Next, an explanation will be made for a compressor of a second embodiment by referring to FIG. 4.

The present embodiment is constituted in the same way as the first embodiment except that the configuration of the constriction passage connecting the separation chamber 42 with the annular space 37. Therefore, some of the symbols or numerals used in the previous explanation are used commonly here for the sake of convenience. An explanation will be omitted from common constitutions and made only for changed constitutions.

Figure 4:
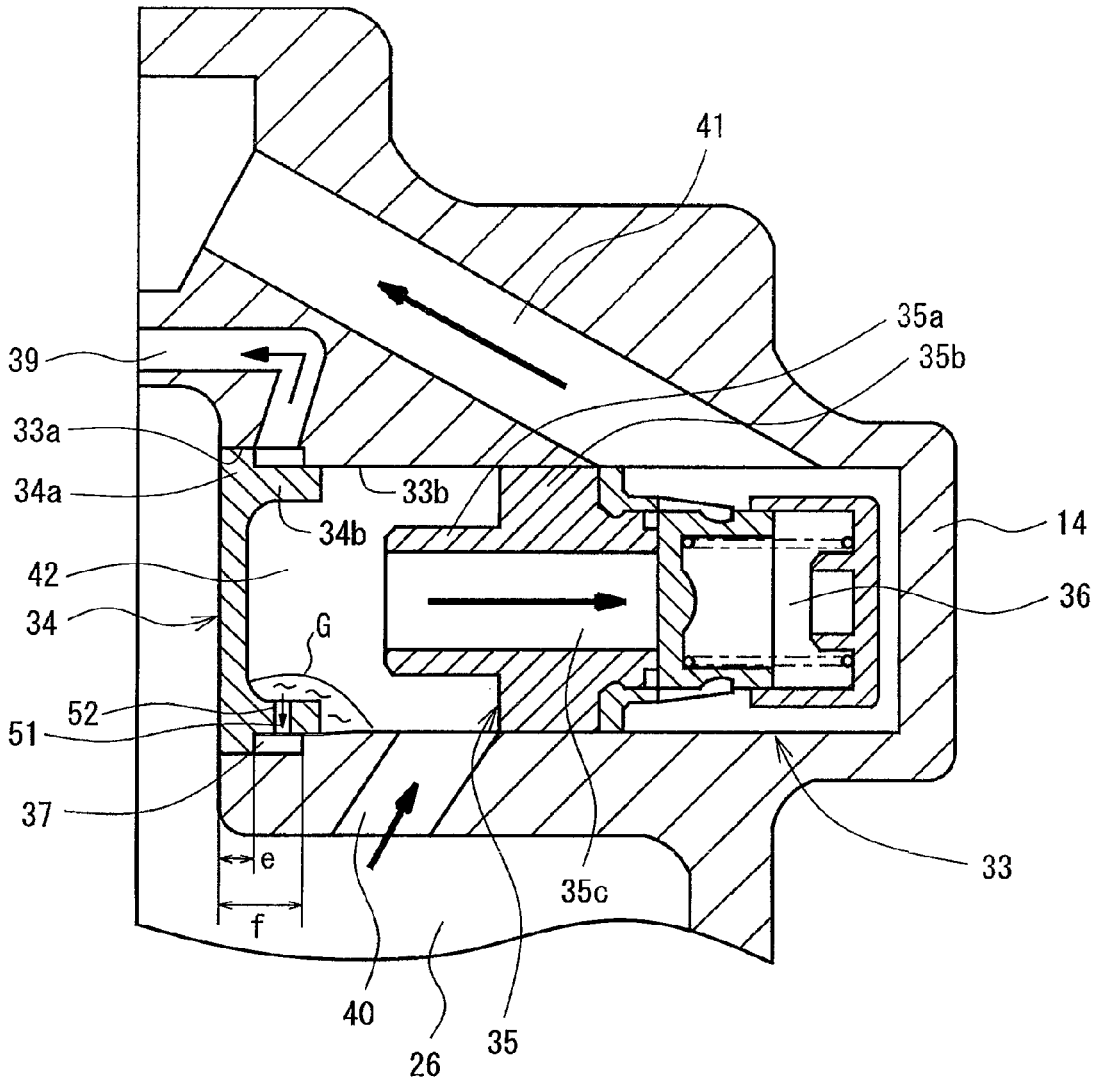
FIG. 4 is an enlarged view of a main portion of a compressor according to a second embodiment of the present invention.

As shown in FIG. 4, the constriction passage 51 of the present embodiment is formed by a through hole 52 provided in the lowest part of the outer ring portion 34*b* of the lid 34 so as to extend in a perpendicular direction (vertical direction in FIG. 4) with respect to the axial line of the lid 34. The separation chamber 42 is connected to the annular space 37 by the constriction passage 51. Therefore, oil G separated by the discharge refrigerant gas and reserved at the bottom of the separation chamber 42 flows into the annular space 37 through the constriction passage 51.

According to the present embodiment, the following advantage are obtained in addition to the advantages of (1) through (4) described in the first embodiment.

(1) The through hole 52 is formed in the outer ring portion 34*b* of the lid 34, thereby forming the constriction passage 51 which connects the separation chamber 42 with the annular space 37. It is not necessary to process the housing of the compressor but sufficient to process only the lid 34 for forming the constriction passage 51. That is, the constriction passage 51 can be made easily.

Next, an explanation will be made for a compressor of a third embodiment by referring to FIG. 5.

The present embodiment is constituted in the same way as the first embodiment except that the configuration of the lid 34 and the oil separator 35. Therefore, some of the symbols and numerals used in the previous explanation will be used commonly here for the sake of convenience. An explanation will be omitted from common constitutions and made only for changed constitutions.

Figure 5:
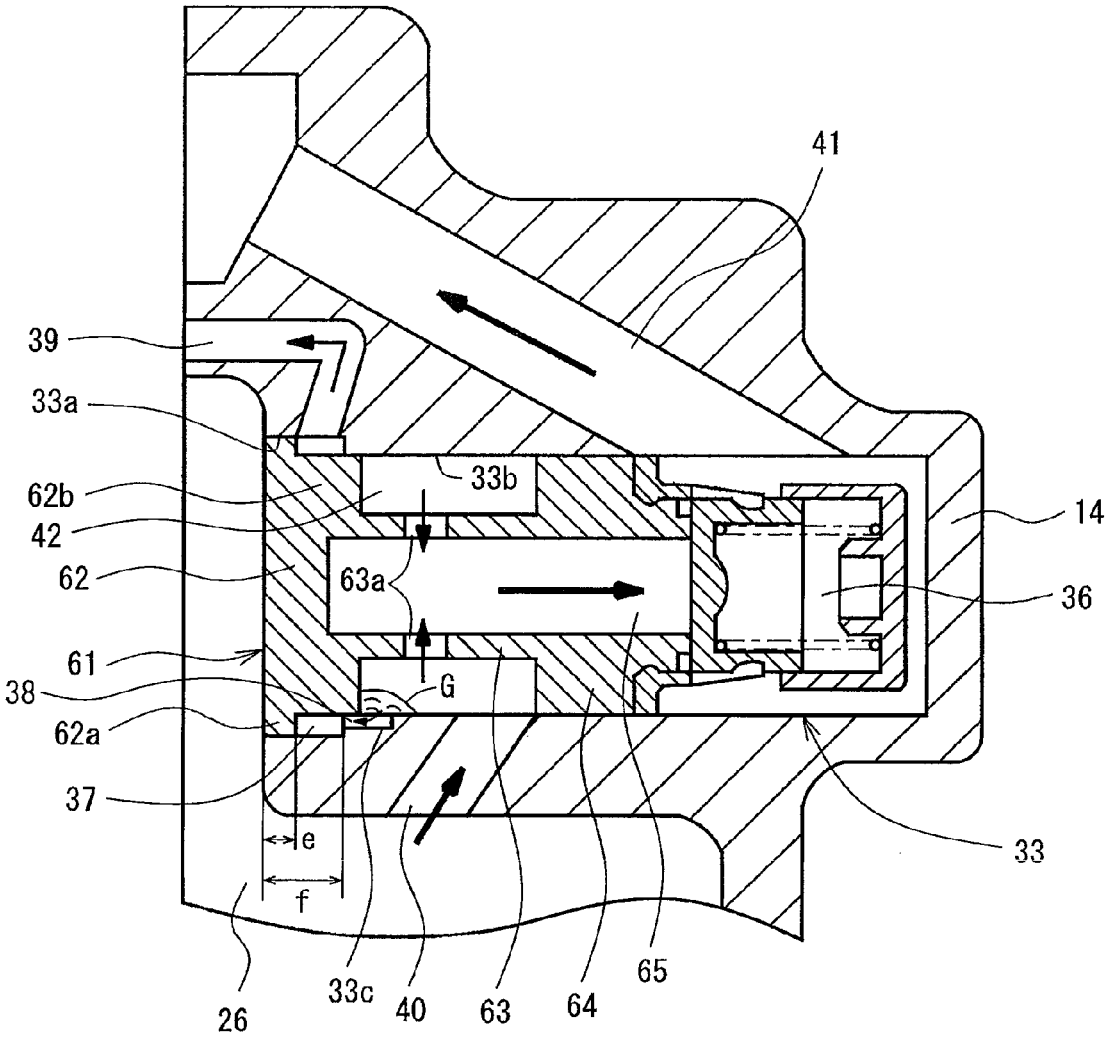
FIG. 5 is an enlarged view of a main portion of a compressor according to a third embodiment of the present invention.

As shown in FIG. 5, in the compressor of the present embodiment, a lid 62, which partitions the separation chamber 42 from the discharge chamber 26, is integrally formed with the oil separator 35. Specifically, a member 61 is constituted by the lid 62, which partitions the separation chamber 42 from the discharge chamber 26, a cylindrical portion 63 functioning as the oil separator 35, and a base portion 64 for reserving the cylindrical portion 63. A conduit 65 is provided in the member 61, and the conduit 65 is opened at the back (in the lateral direction in FIG. 5).

In a state that a check valve 36 is attached to the opening of the conduit 65, as shown in FIG. 5, the base portion 64 of the member 61 is inserted into the cylindrical hole 33. The base portion 64 is fitted into an inner wall surface 33*b*, the outer ring portion 62*b* of the lid 62 is fitted into the inner wall surface 33*b*, and the flange portion 62*a* is fitted into the diameter-enlarged hole 33*a*, by which the member 61 is fixed to the cylindrical hole 33. The thickness dimension e of the flange portion 62*a* in the axial direction is set to be smaller than the depth dimension f of the diameter-enlarged hole 33*a* in the axial direction (e<f).

A separation chamber 42 is formed in a donut-shaped space enclosed by the lid 62, the cylindrical portion 63, the base portion 64 and the inner wall surface 33*b*. The discharge chamber 26 is connected to the separation chamber 42 via the introduction passage 40. A gas passage hole 63*a*, which connects the separation chamber 42 with the conduit 65, is formed in the cylindrical portion 63 of the member 61 so as to extend in a direction orthogonal with the center axial line of the conduit 65, and opened in the separation chamber 42. In the present embodiment, the gas passage hole 63*a* extends in a direction orthogonal with the center axial line of the conduit 65.

A step portion is formed by the flange portion 62*a* and the outer ring portion 62*b* on the outer circumferential surface of the lid 62. In a state that the member 61 is fixed to the cylindrical hole 33, an annular space 37 is formed as an oil reservoir between a step portion on the outer circumferential surface of the lid 62 and a step portion on the inner wall surface 33*b* of the cylindrical hole 33. The annular space 37 is an annular groove formed around the lid 62, the cross section of which is rectangular. The annular space 37 functions as an oil reservoir connected to the separation chamber 42.

In the above described compressor, refrigerant gas discharged from the discharge chamber 26 is introduced into the separation chamber 42 through the introduction passage 40. The discharged refrigerant gas introduced into the separation chamber 42 flows toward the front of the cylindrical portion 63, while swirling in a space between the inner wall surface 33*b* and the cylindrical portion 63 along the inner wall surface 33*b*. At this time, misted oil contained in the discharged refrigerant gas is separated from the refrigerant gas by the actions of centrifugal force. The thus separated oil swirls inside the separation chamber 42 due to the influence of the swirling refrigerant gas, a part of which drops along the inner wall surface 33*b* of the separation chamber 42 due to its own weight and collects in the vicinity below the lid 62 at the bottom of the separation chamber 42.

Discharged refrigerant gas, from which oil has been separated, is introduced into the check valve 36 after flowing into the conduit 65 through the gas passage hole 63*a* formed in front of the cylindrical portion 63. The discharged refrigerant gas introduced into the check valve 36 is drained to the discharge flange 43 through the drain passage 41.

Oil G, which collects at the bottom of the separation chamber 42, flows to an annular space 37 through the constriction passage 38 and elevates the annular space 37 to flow quickly into the reservoir chamber 47 due to a pressure difference $\Delta P$ between the separation chamber 42 and the reservoir chamber 47.

According to the present embodiment, the following advantages are obtained in addition to the advantages of (1) through (5) described in the first embodiment.

(1) The lid 62, which partitions the separation chamber 42 from the discharge chamber 26, the cylindrical portion 63 functioning as the oil separator 35 and the base portion 64 are formed in an integrated manner so as to constitute the single member 61, thus making it possible to reduce the number of components and also simplify the assembly.

Figure 6:
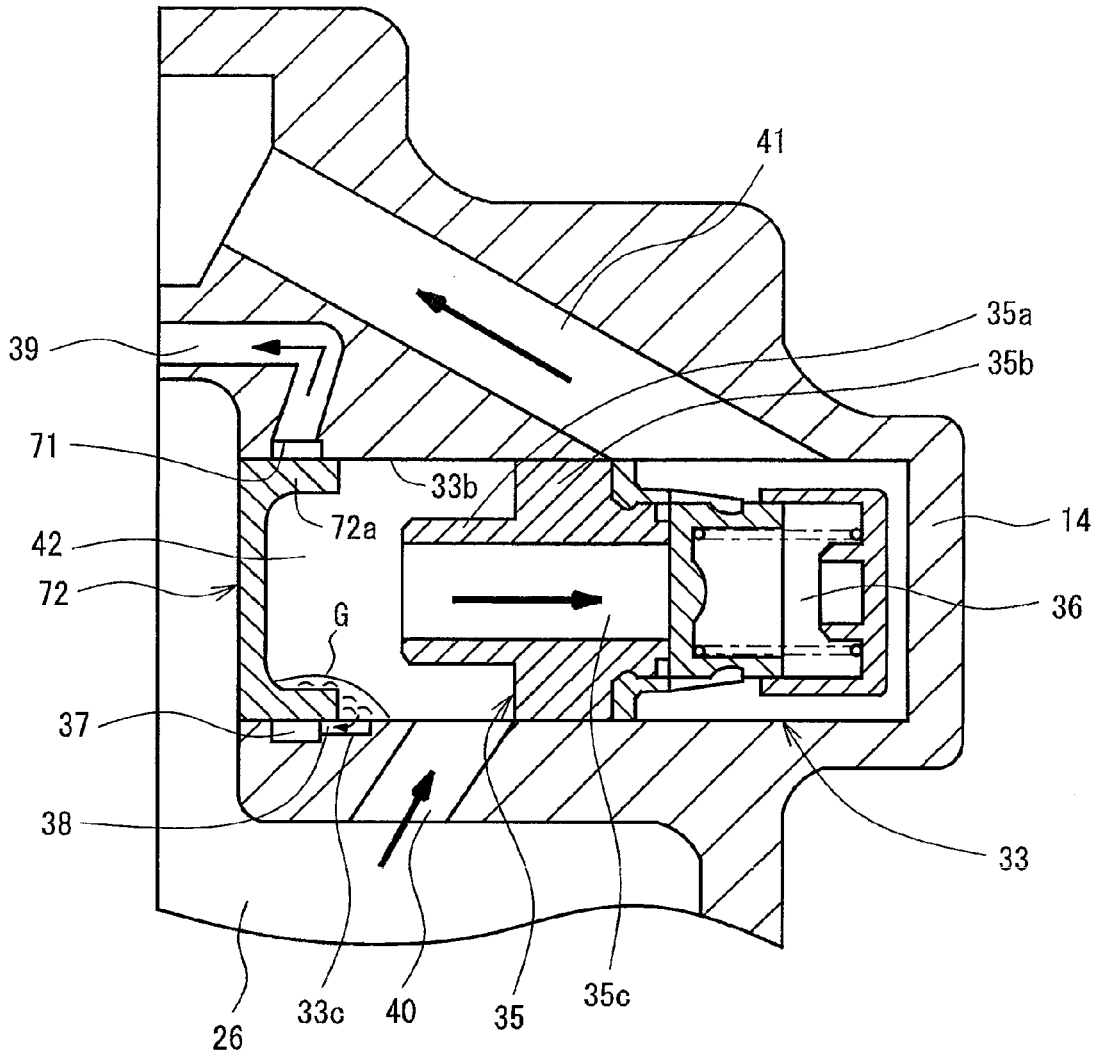
FIG. 6 is an enlarged view of a main portion of a compressor according to a fourth embodiment of the present invention.

The compressor of the fourth embodiment shown in FIG. 6 is the same as the compressor of the first embodiment except for the method for forming an annular space. Constitutions, which are the same as those of the compressor of the first embodiment, will be given the same symbols or numerals, and detailed explanations thereof are omitted.

In FIG. 6, an annular groove 71, the cross section of which is rectangular, is formed on the inner wall surface 33*b* in the inlet portion of the cylindrical hole 33 formed in the rear housing member 14. The annular groove 71 is provided in a position connected to the oil passage 39. A lid 72 is provided with a tubular outer ring portion 72*a* having a constant outer diameter in the axial direction but devoid of a flange portion.

Therefore, the outer ring portion 72*a* of the lid 72 is fitted into the inner wall surface 33*b*, thereby forming an annular space 37 as an oil reservoir between the annular groove 71 and the outer circumferential surface of the outer ring portion 72*a*. The annular space 37 functions as an oil reservoir connected to the separation chamber 42.

The annular groove 71 may be formed on the outer circumferential surface of the outer ring portion 72*a* in place of the rear housing member 14.

In forming the annular space 37 used in the compressor of the fourth embodiment, the annular groove 71 may be formed only on one of the rear housing member 14 and the lid 72. It is, therefore, expected to reduce the number of processing steps.

Figure 7:
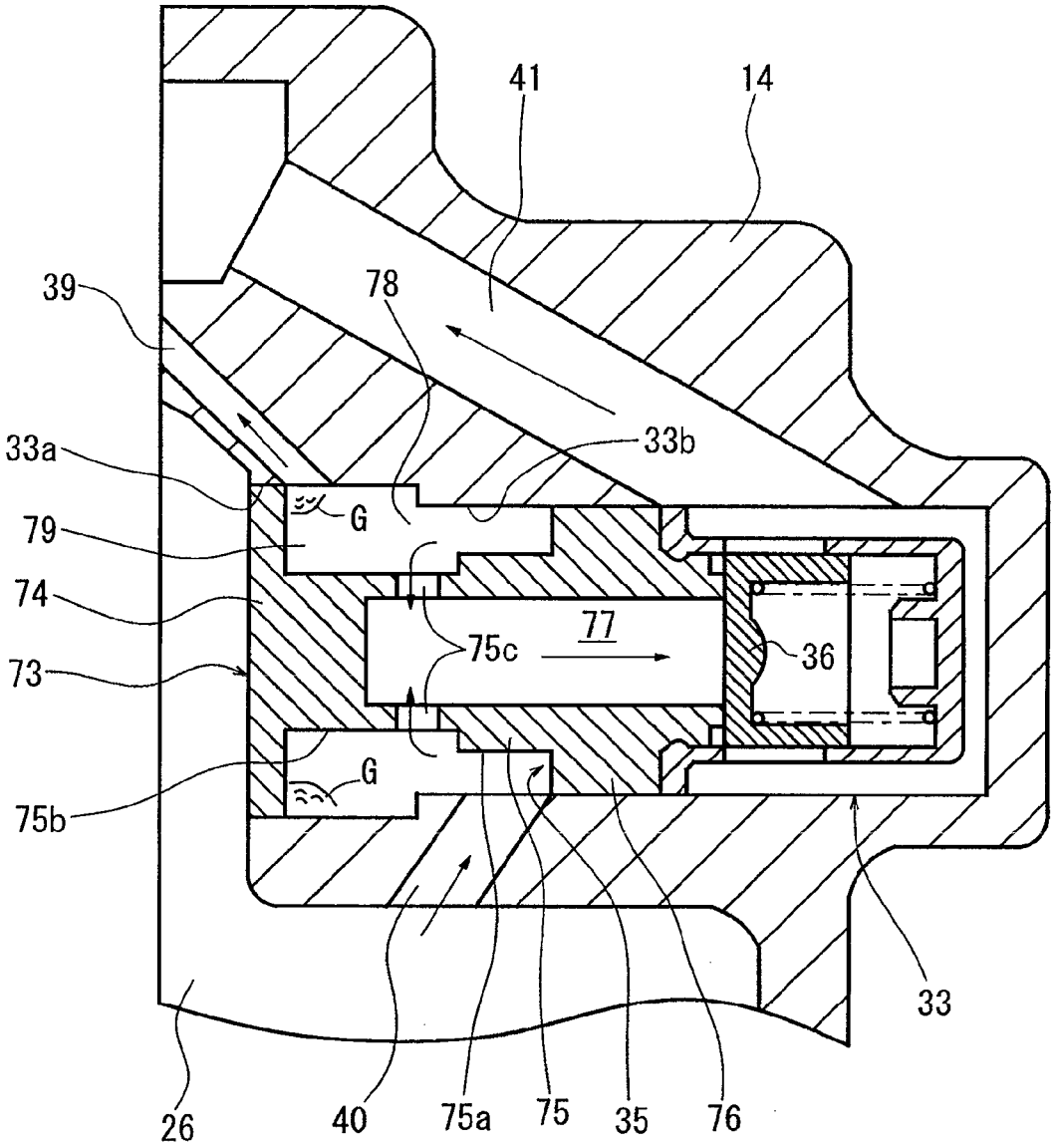
FIG. 7 is an enlarged view of a main portion of a compressor according to a fifth embodiment of the present invention.

The compressor of the fifth embodiment shown in FIG. 7 is the same as compressor of the third embodiment except for the configuration of the annular space as an oil reservoir of the compressor. Constitutions, which are the same as those of the compressor of the third embodiment, will be given the same symbols or numerals, and detailed explanations thereof are omitted.

In FIG. 7, the lid 74 and the oil separator 35 made up of a cylindrical portion 75 and a base portion 76 are constituted as an integrally formed member 73. The member 73 is arranged in the cylindrical hole 33 in a state that the check valve 36 is attached to the side of an opening (on the right in the drawing) of a conduit 77 formed in the oil separator 35. The lid 74 is formed in a flange shape and the cylindrical portion 75 is provided with a large diameter portion 75*a* and a small diameter portion 75*b*. The small diameter portion 75*b* is arranged between the lid 74 and the large diameter portion 75*a*.

The cylindrical hole 33 is provided with a large diameter-enlarged hole 33*a* on the side opened in the discharge chamber 26. The diameter-enlarged hole 33*a* is extended axially up to the vicinity of the large diameter portion 75*a* in the cylindrical portion 75. Therefore, a zone on the lid 74 in the separation chamber 78 defined by the member 73, the diameter-enlarged hole 33*a* of the cylindrical hole 33 and the inner wall surface 33*b* forms an annular space 79 which is expanded to a greater extent than others. The annular space 79 acts as an oil reservoir connected to the separation chamber 78.

The base portion 76 and the lid 74 are press-fitted respectively into the inner wall surface 33*b* and the diameter-enlarged hole 33*a*, by which the member 73 is fixed to the cylindrical hole 33. A gas passage hole 75*c* extending in a direction crossing at a right angle with the center axial line of the conduit 77 is disposed at four positions of the small diameter portion 75*b* and opened in the separation chamber 78. It is preferable that the gas passage hole 75*c* is disposed at a position which is as close to the large diameter portion 75*a* as possible. The oil passage 39 is directly opened in the uppermost part of an annular passage 79, which is an oil reservoir, and set to be of such a dimension that a certain constriction is given to prevent high-pressure refrigerant gas in the separation chamber 78 from flowing into the reservoir chamber 47. The introduction passage 40 for refrigerant gas, which connects the discharge chamber 26 with the separation chamber 78, is provided in the rear housing member 14 forming the cylindrical hole 33 so as to tilt against the center axial line of the conduit 77 and is opened toward the large diameter portion 75*a* of the cylindrical portion 75.

In the thus constituted compressor of the fifth embodiment, high-pressure refrigerant gas introduced from the discharge chamber 26 into the separation chamber 78 via the introduction passage 40 swirls around the large diameter portion 75*a*, as in the first embodiment, by which oil contained in the refrigerant gas is centrifuged. The thus separated oil swirls in the annular space 79 to gather around the lid 74 and the wall face of the diameter-enlarged hole 33*a*. A part of the oil drops due to its own weight and collects in the lower part of the annular space 79 (bottom in FIG. 7) as well.

Oil G which swirls and gathers around the upper wall face (above in FIG. 7) of the annular space 79 flows into the reservoir chamber 47 through the oil passage 39 due to a pressure difference. The oil G, which collects on the lower wall face of the annular space 79, gradually swirls upwardly by a swirling flow inside the annular space 79 and sequentially drained from the oil passage 39 to the reservoir chamber 47.

Refrigerant gas, from which oil has been separated in the separation chamber 78, flows from the gas passage hole 75*c* into the conduit 77, opening up the check valve 36 to the right as shown in FIG. 7 depending on the pressure of the refrigerant gas, thus flowing from the drain passage 41 to the external refrigerant circuit 48 (refer to FIG. 1).

The compressor of the fifth embodiment has the following advantages in addition to the advantages described in the third embodiment.

(1) The annular space 79 is expanded in the radial direction of the cylindrical hole 33, by which the lid 74 and the wall face of the diameter-enlarged hole 33*a* on which oil G collects are positioned away from the gas passage hole 75*c*. Therefore, prevented is a phenomenon where the centrifuged oil G is taken into the conduit 77 by refrigerant gas, thus making it possible to reduce the oil concentration of the refrigerant gas flowing into the external refrigerant circuit 48.

(2) Since the gas passage hole 75*c* is formed in the small diameter portion 75*b* of the cylindrical portion 75 constituting the oil separator 35, it is possible to make the gas passage hole 75*c* short in length and to reduce the pressure loss of refrigerant gas flowing into the conduit 77.

(3) Since the member 73 is press-fitted and fixed to the cylindrical hole 33, the lid 74 and the base portion 76 are fixed stably even when they are made thin. Therefore, it is possible to form the separation chamber 78 long to separate oil more effectively. Further, no seal member is needed to reduce the number of components.

Figure 8:
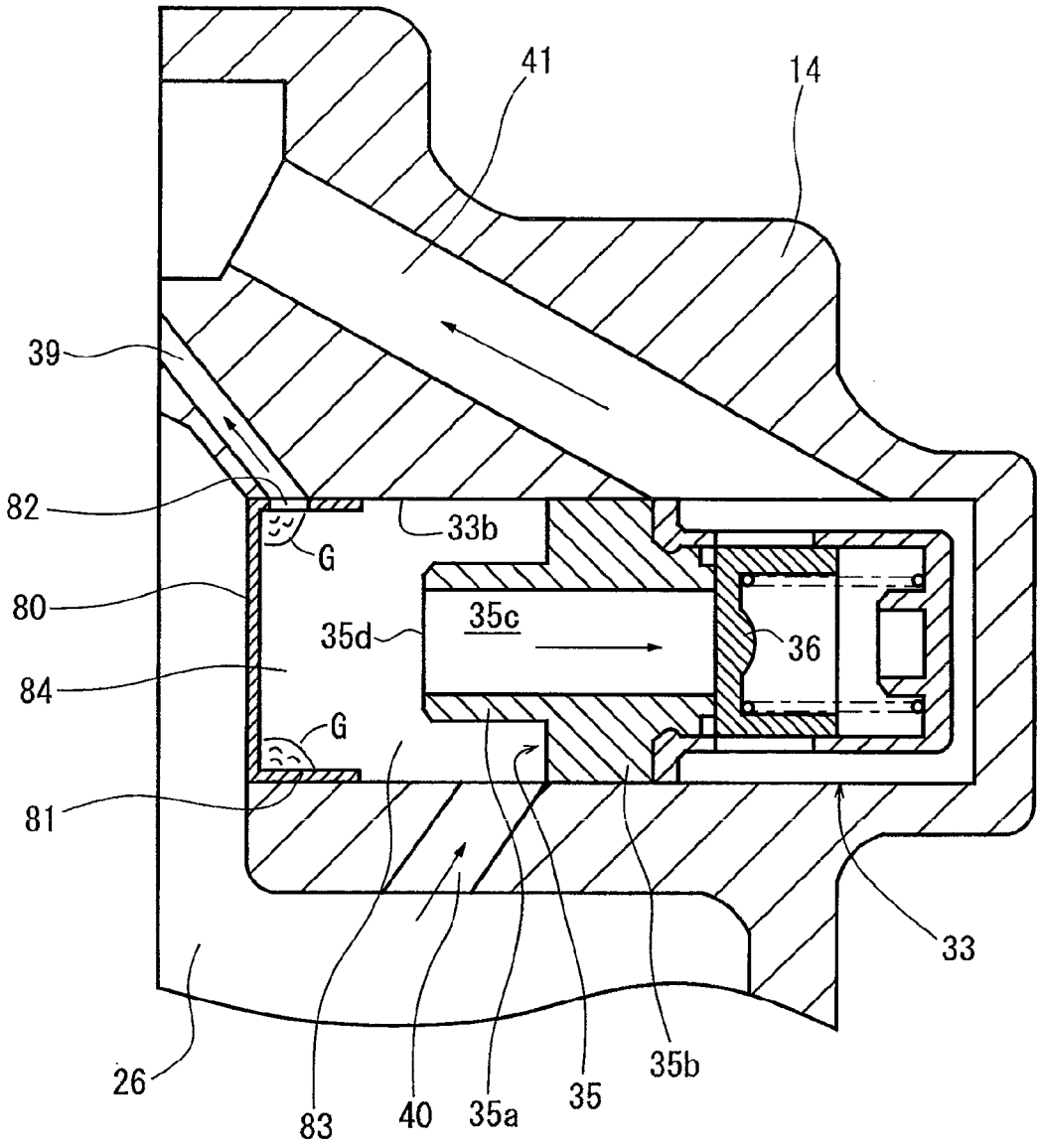
FIG. 8 is an enlarged view of a main portion of a compressor according to a sixth embodiment of the present invention.

The compressor of the sixth embodiment shown in FIG. 8 is the same as the first embodiment except for the configuration of the constitution of the lid 34. The constitutions, which are the same as those of the compressor of the first embodiment, will be given the same symbols or numerals, and detailed explanations thereof are omitted.

In FIG. 8, the inner wall surface 33*b* of the cylindrical hole 33 is constant in diameter in the axial direction and opened in the discharge chamber 26. A lid 80 is made of an iron plate obtained by pressing a thin iron plate. The lid 80 has a cylindrical outer ring portion 81. The lid 80 is not restricted to the iron plate as a material but may be formed by using other rigid materials and also formed by a molding method. An outer ring portion 81 is provided with a constriction passage 82 at a position corresponding to the oil passage 39 disposed in the upper part (above in FIG. 8) of the rear housing member 14 and constituted so that the oil passage 39 coincides with the constriction passage 82 when the lid 80 is press-fitted and fixed to the inner wall surface 33*b*.

In FIG. 8, the constriction passage 82 and the oil passage 39 are formed identical in diameter. However, as long as the constriction passage 82 is large enough to give a sufficient constriction effect, the oil passage 39 may be larger in diameter than the constriction passage 82 so that it can be worked easily and oil is allowed to flow easily. The lid 80 extending from the side end face of the discharge chamber 26 up to the constriction passage 82 must be long enough in sealing a space between the discharge chamber 26 and the separation chamber 83 to be described below. However, it is preferable that the length is made as short as possible and the inlet of the constriction passage 82 is positioned away from the inlet 35*d* of the conduit 35*c* as much as possible.

The base portion 35*b* of the oil separator 35 to which the check valve 36 is attached is press-fitted into the cylindrical hole 33 and the outer ring portion 81 of the lid 80 is also press-fitted into the cylindrical hole 33, by which a separation chamber 83 is formed between the oil separator 35 and the lid 80, and an oil reservoir 84 is also formed along the inner circumferential surface of the outer ring portion 81 of the lid 80. The oil reservoir 84 functions as an oil reservoir connected to the separation chamber 83.

In the compressor of the sixth embodiment, high-pressure refrigerant gas in the discharge chamber 26 is supplied to the cylindrical portion 35*a* of the oil separator 35 through the introduction passage 40 and moved to the lid 80, while swirling therearound, by which oil is centrifuged. The refrigerant gas, from which oil has been separated, flows into the conduit 35*c* from the inlet 35*d*, opening up the check valve 36 due to its own pressure, thereby flowing into the drain passage 41. Oil G separated from the refrigerant gas is influenced by a swirling flow of the refrigerant gas to swirl around the oil reservoir 84, and a part of the oil collects in the lower part (bottom in FIG. 8) of the oil reservoir 84 due to its own weight. Therefore, of swirling oil, oil G existing in the upper part shown in FIG. 8 flows to the oil passage 39 through the constriction passage 82 due to a pressure difference and is drained to the reservoir chamber 47 (refer to FIG. 1).

The compressor of the sixth embodiment has the following advantages.

(1) Since the oil G swirling around the oil reservoir 84 is drained to the oil passage 39 due to a pressure difference, the reservoir chamber 47 is arranged with an improved flexibility of the design. This allows the compressor to be miniaturized.

(2) Since the lid 80 is made thin, it is possible to make the separation chamber 83 long and prevent a phenomenon that the separated oil is taken to the conduit 35*c* together with refrigerant gas.

Figure 9:
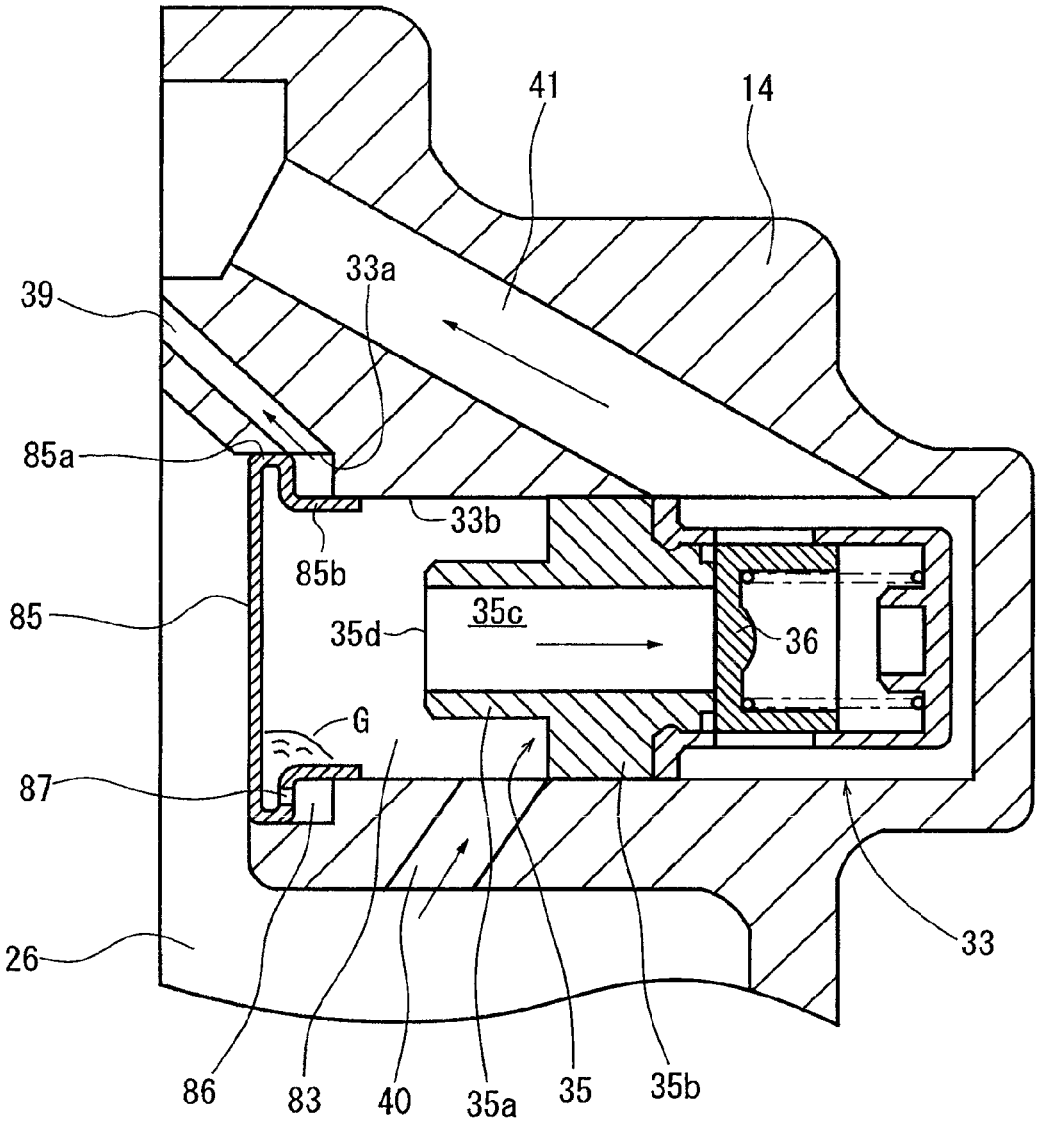
FIG. 9 is an enlarged view of a main portion of a compressor according to a seventh embodiment of the present invention.

The compressor of the seventh embodiment shown in FIG. 9 is the same as the compressors of the first and sixth embodiment except for the configuration of the lid. Constitutions, which are the same as those of the compressor of the first and sixth embodiments, will be given the same symbols or numerals, and detailed explanations thereof are omitted.

In FIG. 9, a step is formed by the diameter-enlarged hole 33*a* front to the inner wall surface 33*b* of the cylindrical hole 33 constituting a discharge passage, and the oil passage 39 connected to the reservoir chamber 47 (refer to FIG. 1) is opened near the step portion of the diameter-enlarged hole 33*a*, the constitution of which is similar to that of the compressor of the first embodiment. The lid 85 is a plate material formed by pressing an iron plate, as in the compressor of the sixth embodiment. The lid may be formed by using other materials or by a different working method. The lid 85 is formed as a cylinder with a bottom and provided with a large-diameter flange portion 85*a* and an outer ring portion 85*b*, the outer diameter of which is equal to the inner diameter of the inner wall surface 33*b*.

The flange portion 85*a* of the lid 85 and the outer ring portion 85*b* are press-fitted and fixed respectively to the diameter-enlarged hole 33*a* of the separation chamber 83 and the inner wall surface 33*b* of the separation chamber 83, by which an annular space 86 is formed between the outer circumferential surface of the outer ring portion 85*b* and the inner circumferential surface of the diameter-enlarged hole 33*b*. A constriction passage 87 is drilled in a longitudinal wall, which is in the lower part (bottom in FIG. 9) of the lid 85 and connects the flange portion 85*a* with the outer ring portion 85*b*. The separation chamber 83 is connected to the annular space 86 by the constriction passage 87. The annular space 86 functions as an oil reservoir connected to the separation chamber 83.

In the seventh embodiment, high-pressure refrigerant gas in the discharge chamber 26 is supplied to the cylindrical portion 35*a* of the oil separator 35 through the introduction passage 40 and moved to the lid 85, while swirling therearound, by which oil is centrifuged. The refrigerant gas, from which oil has been separated, flows in a similar manner as described in the first and sixth embodiments.

Oil G separated from the refrigerant gas receives a swirling flow of the refrigerant gas, swirling around the inner circumference of the outer ring portion 85*b*. A part of the oil drops due to its own weight and tends to collect in the lower part of the outer ring portion 85*b* (bottom in FIG. 8). The oil G, which collects in the lower part of the outer ring portion 85*b*, flows into the annular space 86 via the constriction passage 87 and is drained to the reservoir chamber 47 (refer to FIG. 1) from the annular space 86 through the oil passage 39 due to a pressure difference. Therefore, the compressor of the seventh embodiment is capable of exhibiting a synergistic effect in combination with the advantages of the compressor described in the first embodiment and those of the compressor described in the sixth embodiment.

Figure 10:
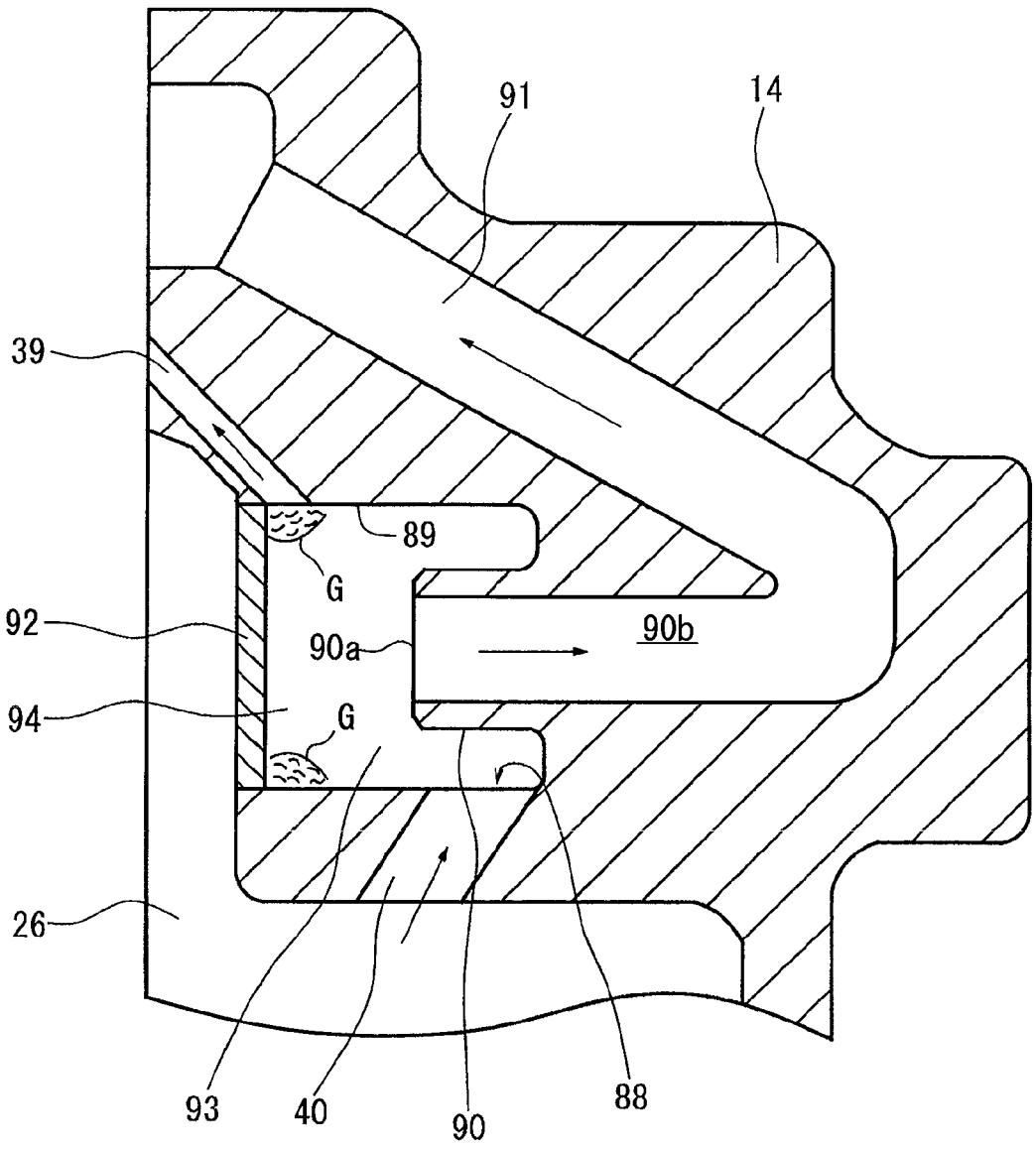
FIG. 10 is an enlarged view of a main portion of a compressor according to an eighth embodiment of the present invention.

The compressor of the eighth embodiment as shown in FIG. 10 is the same as the compressor of the first embodiment except for the points shown below. Constitutions, which are the same as those of the compressor of the first embodiment, will be given the same symbols or numerals, and detailed explanations thereof are omitted.

In the compressor of the eighth embodiment, the oil separator 90 is integrally formed with the rear housing member 14.

In FIG. 10, an inner wall 89 of the discharge passage 88 extending in the axial direction of the drive shaft of the compressor is constant in diameter in the axial direction. A cylindrical oil separator 90 is integrally formed with the rear housing member 14 so as to project into the discharge passage 88. The rear housing member 14 is provided with a drain passage 91, which connects a separation chamber 93 with the high pressure fluid chamber 44, and the drain passage 91 is formed by a through hole bending in a V-letter shape. The drain passage 91 is provided with a conduit 90*b* extending horizontally from the front end of the oil separator 90 to the back of the rear housing member 14 along the axial line of the oil separator 90 and a part extending in an obliquely upward direction from the conduit 90*b* to the rear housing member 14. The conduit 90*b* is provided with an inlet 90*a* opened on the front end of the oil separator 90. An oil passage 39 having an appropriate constriction function is opened on the upper part of the inner wall 89 (above in FIG. 10).

A plate-like lid 92 is press-fitted and fixed to the inner wall 89 of the discharge passage 88. The lid 92 is arranged in such a position that the inner end face coincides with an opening of the oil passage 39. A space between the lid 92 and the oil separator 90 is formed as the separation chamber 93. Also formed is an oil reservoir 94, which is defined by the inner end face of the lid 92 and the inner wall 89. The oil reservoir 94 functions as an oil reservoir connected to the separation chamber 93. The check valve 36 given in the first embodiment may be provided appropriately in a passage leading to the drain passage 91 or to the external refrigerant circuit 48.

In the eighth embodiment, high-pressure refrigerant gas in the discharge chamber 26 is supplied from the introduction passage 40 to the outer circumferential surface of the oil separator 90 and moved to the lid 92 while swirling in a spiral, by which oil is centrifuged. The refrigerant gas, from which oil has been removed, is drained from the inlet 90*a* to the external refrigerant circuit 48 through the conduit 90*b* and the drain passage 91. Oil G, which swirls in the oil reservoir 94 to exist in the upper part, is drained from the oil passage 39 to the reservoir chamber 47 due to a pressure difference.

In addition to the advantages described in the compressor of the first embodiment, the compressor of the eighth embodiment has an advantage that the number of parts for constituting an oil separator and the number of assembly steps are reduced to a great extent to simplify the constitution.

Figure 11:
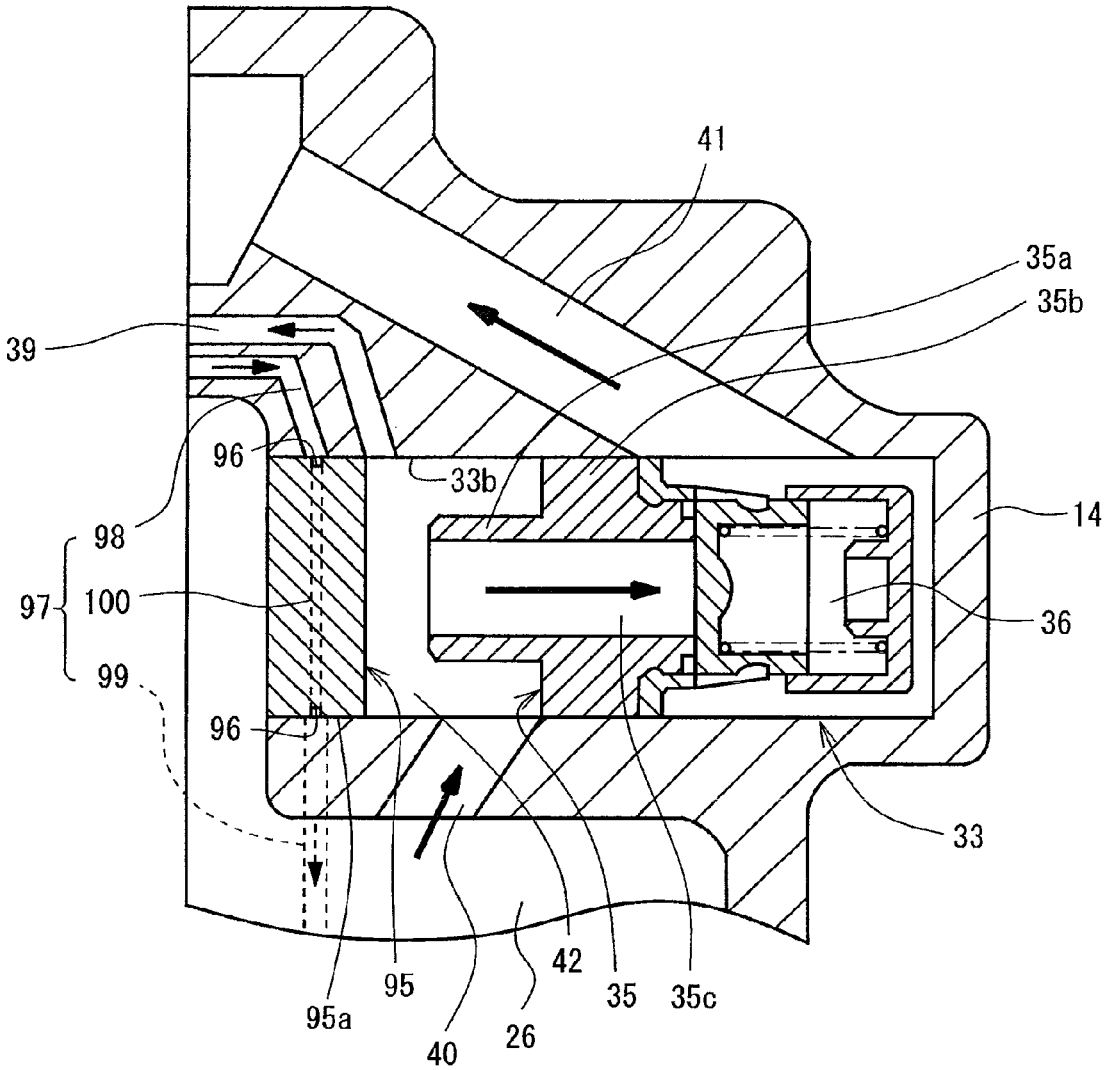
FIG. 11 is an enlarged view of a main portion of a compressor according to a ninth embodiment of the present invention.
Figure 12:
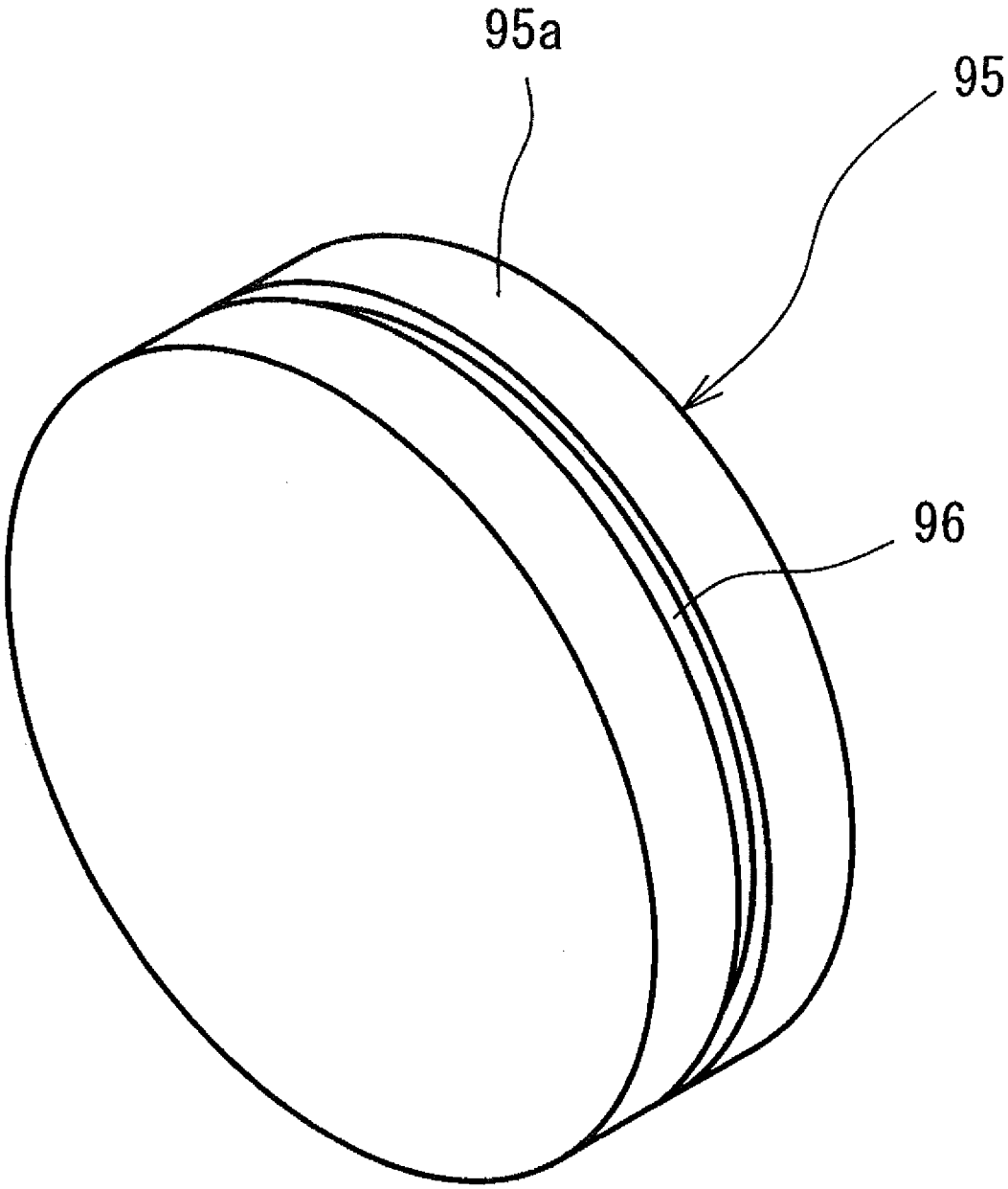
FIG. 12 is a perspective view of a lid according to a ninth embodiment of the present invention.

The compressor of the ninth embodiment shown in FIGS. 11 and 12 is the same as the compressor of the first embodiment except for a part of the compressor. Therefore, constitutions, which are the same as those of the compressor, will be given the same symbols or numerals, and detailed explanations thereof are omitted. In the compressor of the first embodiment, the step 33*c* for forming the constriction passage 38 is formed on the cylindrical hole 33, and the oil passage 39 is connected to the side face of the lid 34 facing an annular space. In the compressor of the ninth embodiment, provided is an oil return passage for supplying oil from the reservoir chamber 47 to the suction chamber 25, which is a low pressure zone.

In FIG. 11, the inner wall surface 33*b* of the cylindrical hole 33 is constant in diameter in the axial direction and opened to the discharge chamber 26. The lid 95 is made of a cylindrical metal member corresponding to the diameter of the cylindrical hole 33. As shown in FIG. 12, an annular groove 96 is formed on the outer circumferential surface 95*a* of the lid 95. The groove 96 constitutes an intermediate oil passage 100, which is a part of an oil return passage 97, corresponding to an oil constriction portion in the oil return passage 97. The groove 96 is easily formed by cutting or pressing by means of a lathe or a pressing machine. The lid 95 is press-fitted and fixed to the cylindrical hole 33 to define the separation chamber 42. In a state that the lid 95 is fixed, there is formed a hermetic intermediate oil passage 100 enclosed by the groove 96 and the inner wall surface 33*b* of the separation chamber 42.

The oil return passage 97 includes the hermetic intermediate oil passage 100 formed by the groove 96 and the inner wall surface 33*b*, an oil upstream passage 98, which connects the reservoir chamber 47 with the groove 96, and an oil downstream passage 99, which connects the groove 96 with the suction chamber 25. Although only partially shown in FIG. 11, the oil upstream passage 98 and the oil downstream passage 99 are formed in the rear housing member 14. The oil upstream passage 98 and the oil downstream passage 99 are set to be greater in the flow passage area than the intermediate oil passage 100. Therefore, the intermediate oil passage 100 functions as an oil constriction portion in the oil return passage 97. Since a constriction effect in the oil constriction portion is dependent on the flow passage area of the groove 96, the flow passage area of the groove 96 is determined by the performance of the compressor. The flow passage area of the oil upstream passage 98 and the oil downstream passage 99 may be set, with production engineering factors taken into account. Oil passing through the oil return passage 97 flows along the inner wall surface 33*b* covering the groove 96 in the intermediate oil passage 100.

The ninth embodiment has the following advantages.

(1) Since there is provided the oil return passage 97 for supplying oil from the reservoir chamber 47 to the suction chamber 25, it is possible to easily form the intermediate oil passage 100, which is a part of the oil return passage 97 only by processing the groove 96 on the outer circumferential surface 95*a* of the lid 95. It is possible to form the oil return passage 97 passing through the lid 95. It is also possible to easily route the oil return passage 97.

(2) The oil constriction portion determines the amount of oil supplied from the reservoir chamber 47 to the suction chamber 25 due to the constriction effect, thus making it possible to prevent refrigerant gas from passing from the reservoir chamber 47 to the suction chamber 25 by using an oil constriction portion.

(3) Since the oil constriction portion is formed in the intermediate oil passage 100, not only the intermediate oil passage 100 but also the oil constriction portion is easily formed. When there is formed an oil constriction portion with a small flow passage area, the oil constriction portion is easily set for accuracy.

(4) Since the intermediate oil passage 100 is the groove 96, the intermediate oil passage 100 corresponds to the oil constriction portion and a flow passage area of the oil constriction portion is set with high accuracy. Further, since there is formed the oil constriction portion along the inner wall surface 33*b*, it is possible to sufficiently secure a distance of the oil constriction portion in the oil return passage 97.

Figure 13:
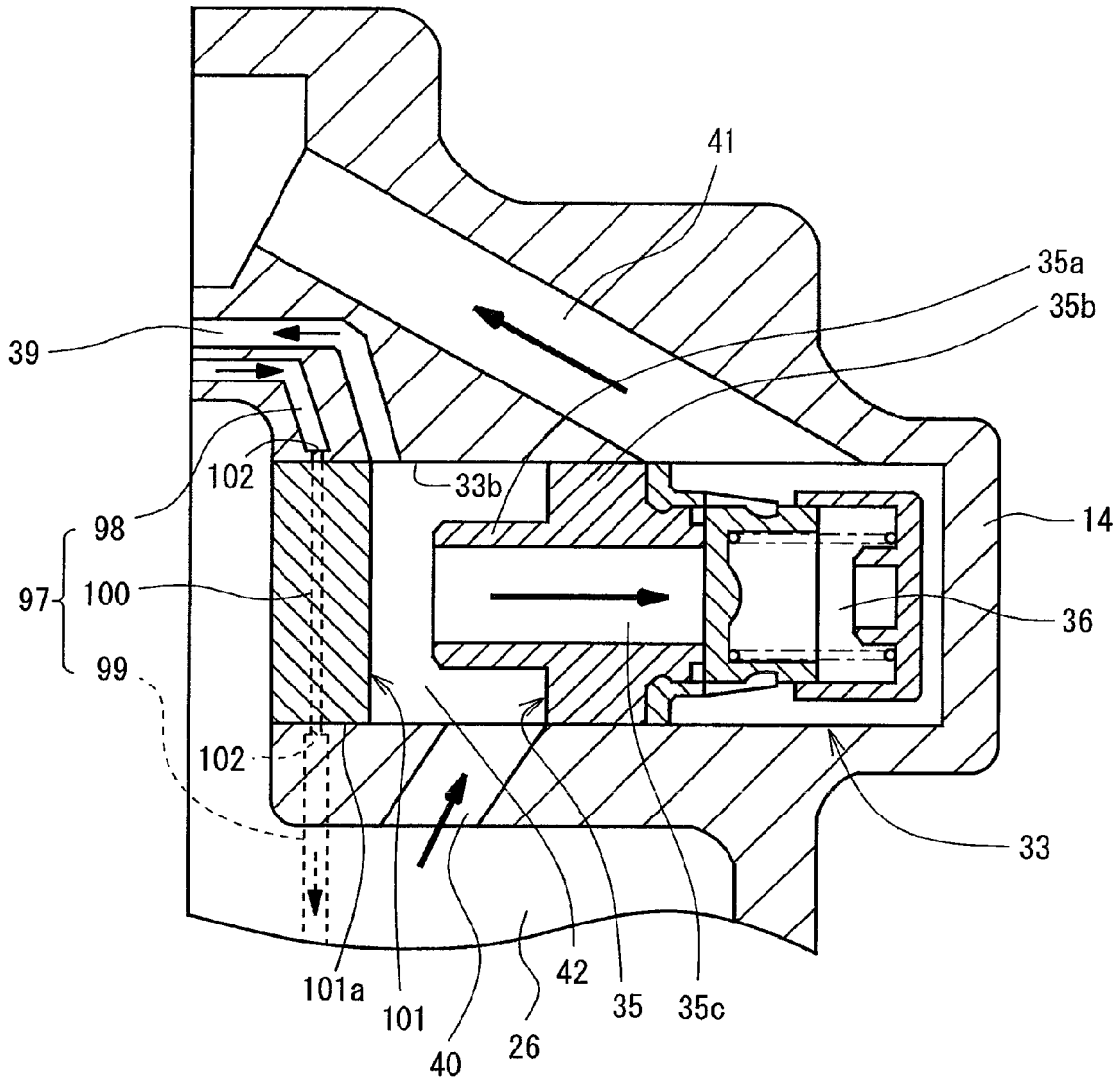
FIG. 13 is an enlarged view of a main portion of a compressor according to a tenth embodiment of the present invention.

The compressor of the tenth embodiment shown in FIG. 13 is the same as the compressor of the ninth embodiment except for the configurations of the lid and the intermediate oil passage. The constitutions, which are the same as those of the compressor described in the first and ninth embodiments, will be given the same symbols or numerals, and detailed explanations thereof are omitted.

As shown in FIG. 13, a lid 101 of the compressor described in the present embodiment is press-fitted into the cylindrical hole 33, but no groove is formed on the outer circumferential surface 101*a* of the lid 101. Of the inner wall surface 33*b* of the separation chamber 42, an annular groove 102 is formed at a site at which the outer circumferential surface 101*a* is in contact. That is, the annular groove 102 is formed in the rear housing member 14. The groove 102 constitutes the intermediate oil passage 100, which is a part of the oil return passage 97, corresponding to the oil constriction portion in the oil return passage 97. The groove 102 can be easily formed by cutting with the use of a lathe. In a state that the lid 101 is fixed, there is formed a hermetic intermediate oil passage 100 enclosed with the groove 102 and the outer circumferential surface 101*a* of the lid 101.

The oil return passage 97 includes the intermediate oil passage 100, the oil upstream passage 98 connecting the reservoir chamber 47 with the groove 102, and the oil downstream passage 99 connecting the groove 102 with the suction chamber 25, which is a low pressure zone. The oil upstream passage 98 and the oil downstream passage 99 are shown only partially in FIG. 13. The groove 102 is smaller in flow passage area than the oil upstream passage 98 and the oil downstream passage 99. The intermediate oil passage 100 functions as an oil constriction portion in the oil return passage 97. Oil passing through the oil return passage 97 flows along the outer circumferential surface 101*a* of the lid 101, which covers the groove 102 in the intermediate oil passage 100.

The compressor of the tenth embodiment has advantages similar to the advantages (2) and (3) of the compressor described in the ninth embodiment. Further, since there is provided the oil return passage 97 for supplying oil from the reservoir chamber 47 to the suction chamber 25, it is possible to easily form the intermediate oil passage 100 only by providing the groove 102 on the inner wall surface 33*b*. Further, since the intermediate oil passage 100 can be easily formed, the oil return passage 97 is easily routed.

Further, since the intermediate oil passage 100 as an oil constriction portion is formed by the groove 102, it is possible to set a flow passage area of the oil constriction portion with higher accuracy. The oil constriction portion is formed along the outer circumferential surface 101*a*, thereby making it possible to sufficiently secure a distance of the oil constriction portion in the oil return passage 97.

Figure 14:
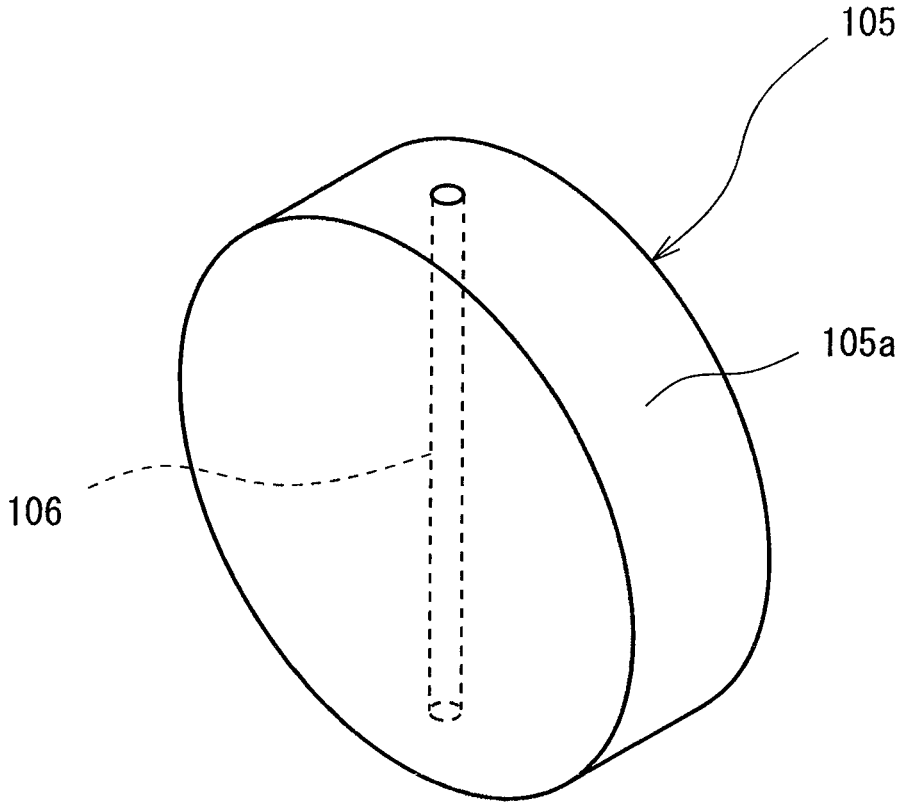
FIG. 14 is a perspective view of a lid according to a an eleventh embodiment of the present invention.

The lid 105 of the compressor described in the eleventh embodiment shown in FIG. 14 is the same as the lid of the compressor of the ninth embodiment except for the configuration of the lid and the intermediate oil passage. The constitutions, which are the same as those of the compressor described in the first and ninth embodiments, will be given the same symbols or numerals, and detailed explanations thereof are omitted.

The lid 105 shown in FIG. 14 is provided with a through hole 106, which extends across the lid 105 in the radial direction. The through hole 106 is formed linearly to constitute the intermediate oil passage 100, which is a part of the oil return passage 97, corresponding to a hermetic oil constriction portion in the oil return passage 97. Openings on both ends of the through hole 106 are respectively arranged on the outer circumferential surface 105*a* of the lid 105. These openings are located at positions corresponding to opening positions of the oil upstream passage 98 and the oil downstream passage 99 on the inner wall surface 33*b*. Therefore, when the lid 105 is press-fitted into the cylindrical hole 33, the direction of the through hole 106 is allowed to coincide with the opening positions of the oil upstream passage 98 and the oil downstream passage 99 and the lid 105 is then press-fitted into the cylindrical hole 33. The through hole 106 is easily formed, for example, by drilling.

The through hole 106 is smaller in the flow passage area than the oil upstream passage 98 and the oil downstream passage 99. This is because the through hole 106 is allowed to function as an oil constriction portion in the oil return passage 97. Oil passing through the oil return passage 97 flows in the through hole 106 in the intermediate oil passage 100.

The compressor of the eleventh embodiment has advantages similar to the advantages (2), (3) of the compressor described in the ninth embodiment. Further, since there is provided the oil return passage 97 for supplying oil from the reservoir chamber 47 to the suction chamber 25, which is a low pressure zone, it is possible to easily form the intermediate oil passage 100 only by providing the through hole 106 on the lid 105. Therefore, the oil return passage 97 is easily routed.

Further, since the intermediate oil passage 100 as an oil constriction portion is formed by the through hole 106, it is possible to set a flow passage area of the oil constriction portion with high accuracy. Further, since there is provided an oil constriction portion passing through the lid 105, the lid 105 can be press-fitted and fixed to the rear housing member 14 more strongly than a case where the oil constriction portion is formed on the outer circumferential surface 105*a* of the lid 105. Still further, oil in the oil return passage 97 is less likely to leak into the separation chamber 72 or the discharge chamber 25.

Next, an explanation will be made for modifications of the compressors given in the ninth to eleventh embodiments by referring to FIGS. 15(*a*) and 15(*b*). For the sake of convenience in making an explanation, the constitutions, which are the same as those of the compressors given in the first and ninth embodiments, will be given the same symbols or numerals, and detailed explanations thereof are omitted. The lid 110 shown in FIG. 15(*a*) is provided with a cylindrical outer ring portion 111, and the outer ring portion 111 is formed, for example, by pressing a metal plate. A small diameter portion bent toward the center in the radial direction is formed at a midpoint of the outer ring portion 111 in the axial direction. A groove 112 is formed on the outer circumferential surface of the outer ring portion 111 corresponding to the small diameter portion. Constituted is the oil return passage 97 when the hermetic groove 112 is positioned so as to coincide with the oil upstream passage 98 and the oil downstream passage 99 in a state that the lid 110 is press-fitted into the cylindrical hole 33.

Figure 15:
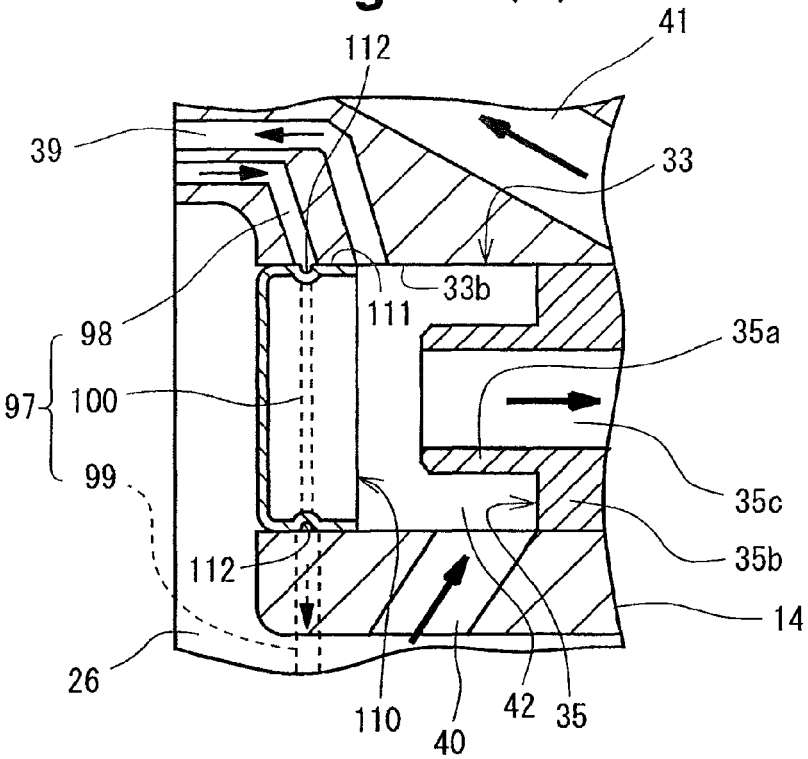
FIG. 15(*a*) is a schematic cross-sectional view of a compressor according to a modification of the ninth through eleventh embodiments.
Figure 15:
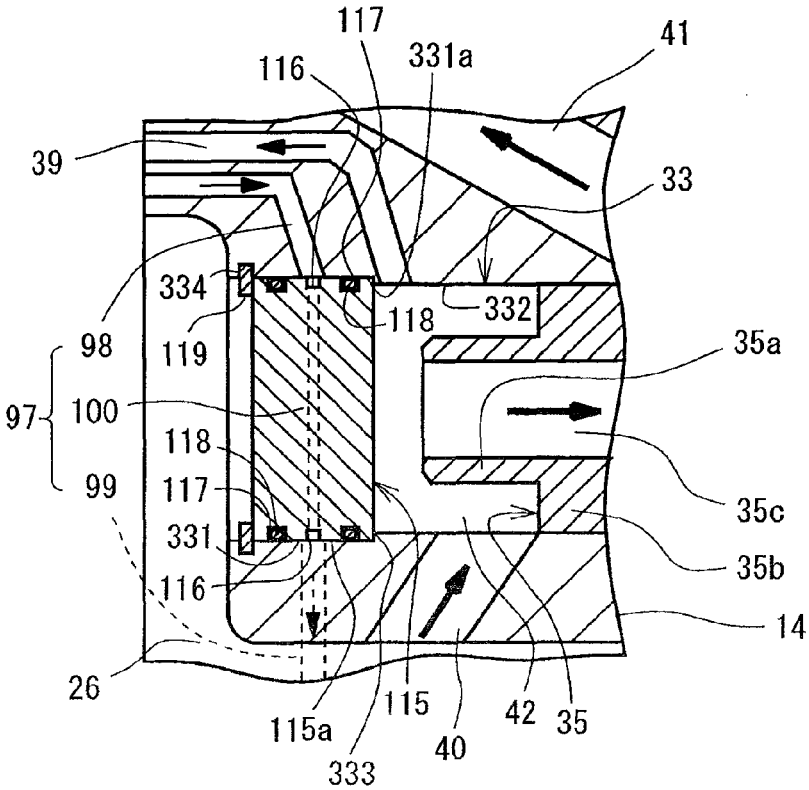

The lid 115 shown in FIG. 15(*b*) is not press-fitted into but fixed to a cylindrical hole 33 by using a snap spring. The cylindrical hole 33 is provided with a large diameter portion 331 corresponding to the diameter of the lid 115 and a small diameter portion 332 smaller in diameter than the lid 115. A step 333 is formed between the large diameter portion 331 and the small diameter portion 332. The lid 115 is in a cylindrical shape, and a sealing groove 117 is formed at both ends on the outer circumferential surface 115*a* of the lid 115 in the axial direction. A groove 116 as the intermediate oil passage 100 is formed between the sealing grooves 117.

Contrastingly, a snap-ring annular groove 334 is formed at a place close to the opening on the inner wall surface 331*a* of the large diameter portion 331. A seal member 118 is attached to the sealing groove 117 of lid 115, and the lid 115 is inserted into the large diameter portion 331 until it hits against the step 333. Then, a snap ring 119 is attached to the annular groove 334, by which the lid 115 is prevented from coming off the cylindrical hole 33. The seal member 118 is provided, by which oil in the oil return passage 97 hardly leaks to the separation chamber 42 or the discharge chamber 26.

Figure 16:
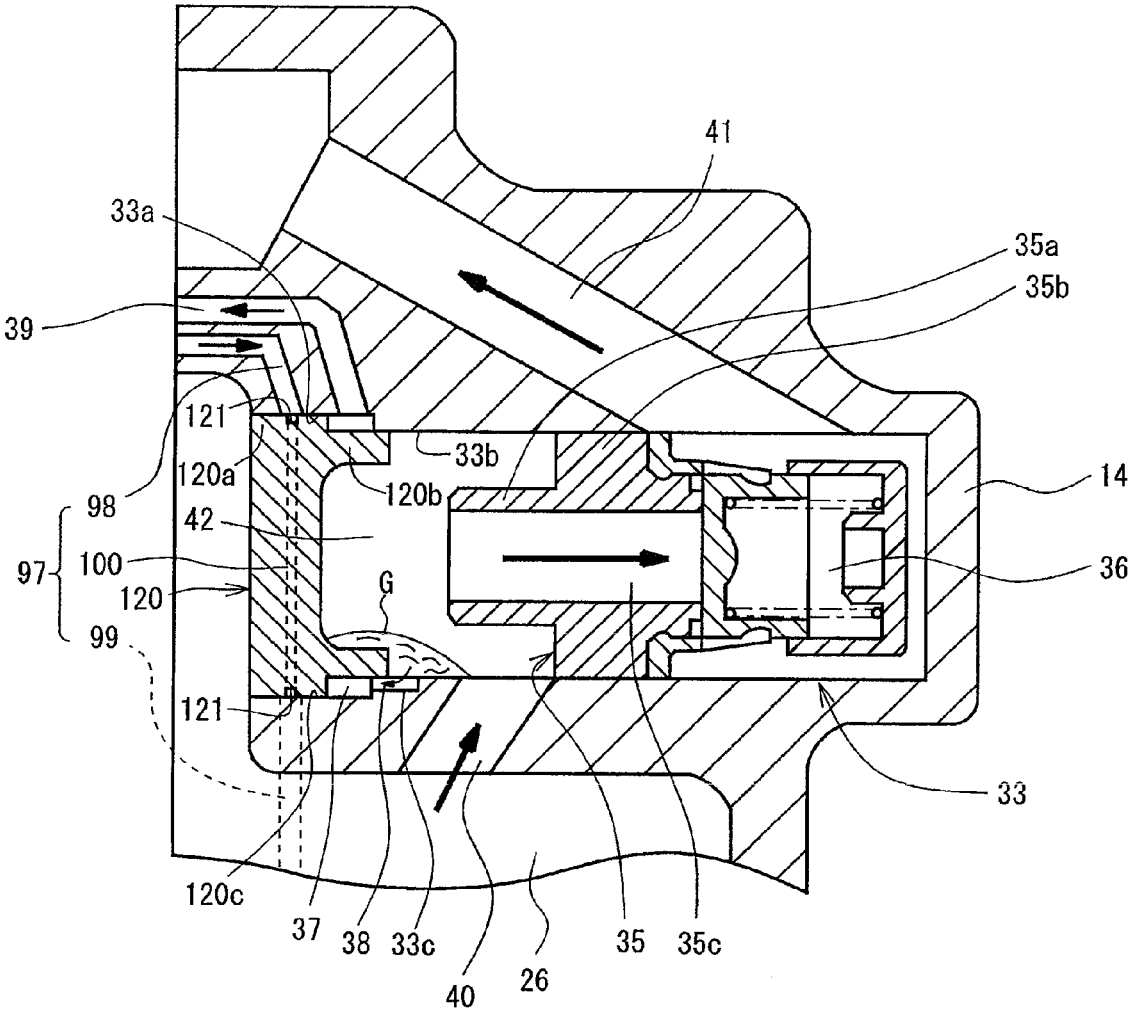
FIG. 16 is an enlarged view of a main portion of a compressor according to a first modified embodiment.
Figure 17:
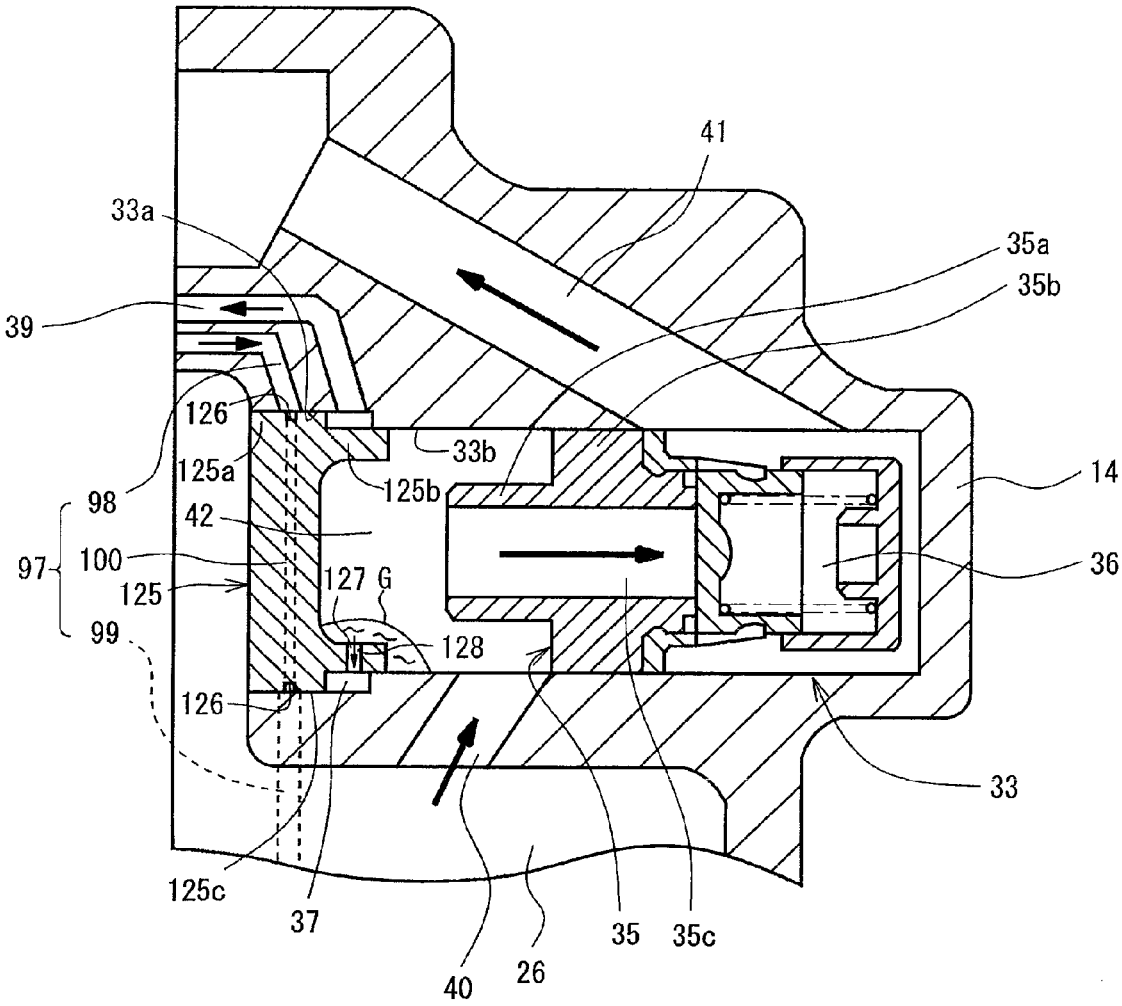
FIG. 17 is an enlarged view of a main portion of a compressor according to a second modified embodiment.

Next, an explanation will be made for other modified embodiments by referring to FIGS. 16 and 17. A first modified embodiment shown in FIG. 16 is partially common in constitution to the compressors given in the first and ninth embodiments. Constitutions common to those of the compressors given in the first and ninth embodiments will be given the same symbols or numerals, and detailed explanations thereof are omitted. In the first modified embodiment, a step 33*c* for forming the constriction passage 38 is formed in the cylindrical hole 33, and an oil passage 39 is connected to an annular space facing the outer circumferential surface of the lid 120. Further, there is provided an oil return passage 97 for supplying oil from the reservoir chamber 47 to the suction chamber 25, which is a low pressure zone.

A diameter-enlarged hole 33*a* greater in diameter than the cylindrical hole 33 is formed at the inlet portion (on the left in FIG. 16) of the cylindrical hole 33. A lid 120, which partitions the discharge chamber 26 from a discharge passage formed by the cylindrical hole 33, is attached at the inlet portion. The lid 120 is provided with a flange portion 120*a* and an outer ring portion 120*b*. A step portion is formed by the flange portion 120*a* and the outer ring portion 120*b* on the outer circumferential surface 120*c* of the lid 120. The lid 120 is fixed to the cylindrical hole 33 by fitting the outer ring portion 120*b* into the inner wall surface 33*b* of the cylindrical hole 33 and also fitting the flange portion 120*a* into the diameter-enlarged hole 33*a*. An annular space 37 is formed by the outer ring portion 120*b* and the diameter-enlarged hole 33*a*. An annular groove 121 is formed on the outer circumferential surface 120*c* of the lid 120 corresponding to the flange portion 120*a*. The groove 121 constitutes the intermediate oil passage 100, which is a part of the oil return passage 97, corresponding to an oil constriction portion in the oil return passage 97.

In a state that the lid 120 is fixed, there is formed a hermetic intermediate oil passage 100 enclosed by the groove 121 and the inner wall surface of the diameter-enlarged hole 33*a*. The oil return passage 97 includes the hermetic intermediate oil passage 100 formed by the groove 121 and the inner wall surface, an oil upstream passage 98 connecting the reservoir chamber 47 with the groove 121, and an oil downstream passage 99 connecting the groove 121 with a suction chamber, which is a low pressure zone. According to the first modified embodiment, oil G, which is separated from the discharge refrigerant gas to collect at the bottom of the separation chamber 42, flows into the annular space 37 through the constriction passage 38 and is supplied to a reservoir chamber 47 through the oil passage 39. Oil in the reservoir chamber 47 is supplied to the suction chamber 25 through the oil return passage 97.

Next, an explanation will be made for a second modified embodiment shown in FIG. 17. The second modified embodiment is partially common in constitution to the compressor given in the second and ninth embodiments. The constitutions common to those of the compressors given in the second and ninth embodiments will be given the same symbols or numerals, and detailed explanations thereof are omitted. In the second modified embodiment, as shown in FIG. 17, the constriction passage 127 is formed on the lid 125, and an oil passage 39 is connected to the annular space 37 facing the outer circumferential surface 125*c* of the lid 125. Further, there is provided an oil return passage 97 for supplying oil from the reservoir chamber 47 to the suction chamber 25, which is a low pressure zone.

The diameter-enlarged hole 33*a* greater in diameter than the cylindrical hole 33 is formed in the inlet portion (on the left in FIG. 17) of the cylindrical hole 33. As shown in FIG. 17, the lid 125 is provided with a flange portion 125*a* and an outer ring portion 125*b*, and a step portion is formed by the flange portion 125*a* and the outer ring portion 125*b* on the outer circumferential surface 125*c* of the lid 125. The outer ring portion 125*b* of the lid 125 is fixed into the cylindrical hole 33. An annular groove 126 is formed on the outer circumferential surface 125*c* corresponding to the flange portion 125*a*. The groove 126 constitutes the intermediate oil passage 100, which is a part of the oil return passage 97, corresponding to an oil constriction portion in the oil return passage 97.

The constriction passage 127 of this embodiment is provided at the lowermost place of the outer ring portion 125*b* of the lid 125 and formed by a through hole 128 extending in a perpendicular direction (above in the FIG. 17) with respect to the axial line of the lid 125. The constriction passage 127 connects the separation chamber 42 with the annular space 37. Therefore, oil G, which is separated from the discharge refrigerant gas to collect at the bottom of the separation chamber 42, flows into the annular space 37 through the constriction passage 127 and is supplied to the reservoir chamber through the oil passage 39. Oil in the reservoir chamber is supplied to a suction chamber through the oil return passage 97.

The present invention is not limited to the above-described embodiments but may be modified in various ways within the scope of the gist of the present invention, and modified, for example, as follows.

The discharge passage described in the first to eighth embodiments may be arranged so as to extend obliquely with respect to the axial direction of the compressor, and an oil separator may be disposed in the discharge passage.

The lid described in the first to fourth embodiments may be press-fitted and fixed into a round hole as described in the fifth to eighth embodiments.

In the third and fifth embodiments, the base portions 64, 76 may be press-fitted and fixed into the cylindrical hole 33 to provide a seal member on the outer circumferential surface of the lids 62, 74. This constitution makes it possible to easily assemble the members 61, 73. The seal member may be provided not only on the outer circumferential surface of the lids 62, 74 but also between a step portion formed on the inner wall surface 33*b* of the cylindrical hole 33 and the end face of the lids 62, 74.

In the first to eighth embodiments, the oil passage 39 may be provided below an oil reservoir. This constitution makes it possible to easily drain oil which collects at the bottom due to its own weight.

In the first to eighth embodiments, a reservoir chamber is provided above a separation chamber. However, the reservoir chamber may be arranged at an optimal place, for example, below the separation chamber or on the side thereof.

In the first to fifth and seventh embodiments, a step formed on the round inner wall surface of the discharge passage or on the outer circumferential surface of the lid and on both of them may be formed in a tapered manner.

The gas passage holes 63*a*, 75*c* described in the first and fifth embodiments extend at a right angle with respect to the center axial line of the conduits 65, 77. However, they may extend so as to give an angle other than a right angle with respect to the center axial line, as long as they extend in a direction intersecting the center axial line. Further, gas passage holes 63*a*, 75*c* are those provided at four places but may be arranged at a plurality of places other than the four places.

In the first to fourth, and seventh embodiments, an annular space formed around the lid has a rectangular cross section. However, the annular space is not restricted thereto but may have a triangular, circular, or oval cross section. That is, the annular space may have any shape of the cross section, as long as it allows oil to pass through.

In the first, third, and fourth embodiments, a constriction passage provided below the lid is formed by providing a step portion on the inner wall surface of the separation chamber. However, it may be formed by providing a step on the outer ring portion of the lid.

In the eighth embodiment, the lid 92 is made thick or the lid 92 is provided with a flange portion, by which the lid 92 may partially project into an opening of the oil passage 39. Thereby, the opening of the oil passage 39 can be made small to increase a constriction effect.

In the ninth to eleventh embodiments and their modifications, in order to easily form an oil constriction portion, an intermediate oil passage in the oil return passage is used to as an oil constriction portion. The intermediate oil passage does not necessarily need to function as an oil constriction portion but the oil constriction passage may be arbitrarily provided in the oil return passage. An oil constriction portion may be provided, for example, in the oil upstream passage and the oil downstream passage.

In the first to eleventh embodiments, the compressor is explained as a variable displacement swash plate type compressor. However, the compressor may be a fixed displacement type compressor or a wobble type compressor. Further, the compressor is not limited to a swash plate type compressor but may be a scroll type compressor and a vane type compressor.

The invention claimed is:

1. A compressor for compressing refrigerant gas containing oil, the compressor comprising:

a cylinder block;

a rear housing member jointed to the cylinder block;

a valve/port forming member located between the cylinder block and the rear housing member, wherein the rear housing member and the valve/port forming member define a discharge chamber into which compressed refrigerant gas is discharged and a suction chamber;

a discharge passage formed in the rear housing member and connected to the discharge chamber, wherein the discharge passage extends parallel with a longitudinal axis of a drive shaft of the compressor and has an opening that opens into the discharge chamber;

a lid attached to the opening of the discharge passage to partition the discharge passage from the discharge chamber, wherein the lid is formed separately from the rear housing member;

an oil separator provided in the discharge passage, wherein a separation chamber is formed between the oil separator and the lid;

an introduction passage formed in the rear housing member for introducing the refrigerant gas from the discharge chamber to the separation chamber, the introduction passage having an outlet that opens into the separation chamber, wherein the oil separator separates oil from the refrigerant gas introduced into the separation chamber;

an oil reservoir provided around the lid, the oil reservoir being connected to the separation chamber to reserve oil separated from the refrigerant gas;

a reservoir chamber for reserving the separated oil, wherein the reservoir chamber is connected to a low pressure zone in the compressor the pressure of which is lower than that in the discharge chamber; and an oil passage formed in the rear housing member and connecting the oil reservoir with the reservoir chamber, the oil passage having an inlet that opens into the discharge passage, wherein the lid is arranged perpendicularly to the longitudinal axis of the drive shaft and faces the valve/port forming member with the discharge chamber located between the lid and the valve/port forming member, and the lid has a first surface that is exposed to the discharge chamber and an opposite second surface that is exposed to the separation chamber, wherein the inlet of the oil passage is spaced apart from the outlet of the introduction passage toward the lid along the longitudinal axis of the drive shaft in the discharge passage.

2. The compressor according to claim 1, wherein the oil reservoir is an annular space formed between the outer circumferential surface of the lid and the inner wall surface of the discharge passage.

3. The compressor according to claim 2, wherein the annular space is connected to the separation chamber via a constriction passage.

4. The compressor according claim 1 wherein the oil reservoir is formed by providing a step portion on at least one of the outer circumferential surface of the lid and the inner wall surface of the discharge passage.

5. The compressor according to claim 1, wherein the oil separator and the lid are formed separately.

6. The compressor according to claim 5, wherein the oil separator is provided with a conduit opened in the separation chamber so as to be opposed to the lid, and the conduit is connected to an external refrigerant circuit.

7. The compressor according to claim 1, wherein the oil separator is integrally formed with the rear housing member.

8. The compressor according to claim 1, wherein the oil separator and the lid are formed integrally.

9. The compressor according to claim 8, wherein the oil separator is provided with a conduit connected to an external refrigerant circuit and a gas passage hole connecting the conduit with the separation chamber, wherein the gas passage hole is provided with an axial line extending in a direction intersecting the center axial line of the conduit, and wherein a site of the oil separator at which the gas passage hole is formed is smaller in outer diameter than other sites of the oil separator so that a space with respect to the separation chamber is expanded.

10. The compressor according to claim 1, wherein the lid is formed with a plate material.

11. The compressor according to claim 10, wherein the lid is provided with a flange portion and a cylindrical outer ring portion which is smaller in diameter than the flange, wherein the oil reservoir is an annular space formed between the outer circumferential surface of the outer ring portion and the inner wall surface of the discharge passage, and the annular space is connected to the separation chamber via a constriction passage.

12. The compressor according to claim 1, wherein at least one of the lid and the oil separator is press-fitted into the discharge passage.

13. The compressor according to claim 1, further comprising an oil return passage for supplying oil reserved in the reservoir chamber to the low pressure zone, wherein the oil return passage is provided with an intermediate oil passage extending through either between the inner wall surface of the discharge passage and the outer circumferential surface of the lid or the lid.

14. The compressor according to claim 13, wherein the oil return passage includes an oil upstream passage connecting the reservoir chamber with the intermediate oil passage, an oil downstream passage connecting the intermediate oil passage with the low pressure zone, and an oil constriction portion.

15. The compressor according to claim 14, wherein the oil constriction portion is formed in the intermediate oil passage.

16. The compressor according to claim 13, wherein the intermediate oil passage is a groove formed on at least one of the outer circumferential surface of the lid and the inner wall surface.

* * * * *